US005452524A

United States Patent [19]

Isozaki et al.

[11] Patent Number: 5,452,524

[45] Date of Patent: Sep. 26, 1995

[54] PHOTOSENSITIVE MATERIAL DRYING METHOD AND APPARATUS

[75] Inventors: Masakazu Isozaki; Mitsuru Katsumata, both of Kanagawa, Japan

[73] Assignee: Fuji Photo Film Co., Ltd., Kanagawa, Japan

[21] Appl. No.: 27,068

[22] Filed: Mar. 5, 1993

[30] Foreign Application Priority Data

| | | | |
|---|---|---|---|
| Mar. 9, 1992 | [JP] | Japan | 4-050913 |
| Apr. 7, 1992 | [JP] | Japan | 4-085356 |
| Apr. 20, 1992 | [JP] | Japan | 4-099449 |

[51] Int. Cl.[6] ..... F26B 3/00

[52] U.S. Cl. ..... 34/454; 34/620; 34/554; 34/114; 34/546

[58] Field of Search ..... 34/155, 116, 120, 34/117, 54, 114, 459, 620, 624, 420, 546, 554, 454, 445

[56] References Cited

U.S. PATENT DOCUMENTS 3,834,040 9/1974 Russell et al. ..... 34/120

OTHER PUBLICATIONS

Patent Abstracts of Japan, JPA 2-149845, Fuji Photo Film Co., Ltd., Toshio Kurokawa.

Patent Abstracts of Japan, JPA 3-132659, Fuji Photo Film Co., Ltd., Toshio Kurokawa.

*Primary Examiner*—Denise L. Gromada

*Attorney, Agent, or Firm*—Sughrue, Mion, Zinn, Macpeak & Seas

[57] ABSTRACT

A photosensitive material drying method for drying a photosensitive material conveyed along a conveying path, including steps of: training a front surface and a rear surface of the photosensitive material alternately around a plurality of heat rollers whose outer circumferences are heated by heat sources; heating the photosensitive material by an amount of heat provided on a basis of a temperature of the outer circumferences of the heat rollers and on the basis of a time of contact between the photosensitive material and the heat rollers; and evaporating moisture from a surface of the photosensitive material not contacting the heat rollers. High-quality drying can be effected in a small space and with little use of electric power. Efficient drying in which dimensions of films are stable can be carried out.

22 Claims, 18 Drawing Sheets

PHOTOSENSITIVE MATERIAL DRYING METHOD AND APPARATUS

BACKGROUND OF THE INVENTION

1. Field of the Invention

The present invention relates to a photosensitive material drying method and apparatus which dry a photosensitive material, such as film sheet, conveyed along a conveying path.

Further, the present invention relates to a temperature controlling method and apparatus which control the temperature of a photosensitive material drying apparatus in which one surface of a photosensitive material, which has an emulsion layer formed on at least one surface thereof, is heated by heat rollers, and drying air is blown to the other surface of the photosensitive material.

Moreover, the present invention relates to a method of controlling a photosensitive material drying apparatus and to a photosensitive material drying apparatus in which a photosensitive material, which has been subject to developing processing by processing solutions, is dried.

2. Description of the Related Art

Latent images of a photosensitive material, on which images are exposed to form latent images, are processed by a photosensitive material processing apparatus such as an automatic processor. The automatic processor is equipped with a developing tank, a fixing tank and a washing tank in which developing solution, fixing solution and washing solution are stored, respectively. While the photosensitive material is automatically conveyed through each of the processing tanks in the automatic developer, the photosensitive material is successively submerged i n the developing solution, the fixing solution and the washing solution so as to undergo developing, fixing and washing processing.

The automatic processor is also equipped with a drying device. The photosensitive material, which has been processed by the aforementioned processing solutions and which has swelled due to the moisture in the processing solutions, is dried while being conveyed automatically in the drying device. In general, in the drying device, hot air is blown on the photosensitive material and the photosensitive material is dried in order to remove moisture therefrom. However, the drying air is repeatedly used in such drying devices in view of heating efficiency, and the humidity of the drying air gradually increases. Therefore, more time is required to dry the photosensitive material.

A system has been proposed in which the photosensitive material is contacted directly to a heating means and moisture is removed by drying air. The heating means of the heating device uses a heat roller or heat rollers. Namely, air containing much of the moisture evaporated from the photosensitive material heated by a direct heating means (heat rollers) is removed from a vicinity of the surface of the photosensitive material by an indirect heating means (drying air), so that the drying of the photosensitive material is expedited. Accordingly, the drying time can be shortened.

Generally, in drying processing by heat rollers, while the photosensitive material is being conveyed along an approximately straight path, the photosensitive material is held and heated between a heat roller and its counter roller at the downstream of the conveying path of the photosensitive material, and drying air is blown on the heated photosensitive material so that the evaporated moisture is removed.

However, in the above-described conventional drying process, the photosensitive material is conveyed in a direction tangent to the pairs of heat rollers. Therefore, the time during which the heat rollers contact the photosensitive material is extremely short. As a result, it is necessary for the temperature of the heat rollers to be high (approximately 100° C. to 150° C.) in order to effect prescribed heating in this short period of time. A drawback arises from the standpoint of safety when there is trouble and the operator is to quickly repair or work on the apparatus. Further, when the photosensitive material becomes jammed, portions of the photosensitive material in the vicinities of the heat rollers are overheated. A drawback arises in that the photosensitive material becomes wavy and can no longer be used. In particular, photosensitive materials used for printing jam easily because the base thickness of the photosensitive material is extremely thin (75μ to 100μ). It is therefore easy for drying defects such as overdrying to occur. Further, it is necessary to sufficiently guard against overheating because dimensional stability of the photosensitive materials is required.

Moreover, with regard to the adjustment of the temperature of heat rollers, the surface temperature of the heat rollers is detected, and a heater is turned on or off in response to a fall from or rise above a set temperature. The surface temperature of the heat rollers is thereby controlled to a predetermined temperature. Further, when photosensitive materials are not being dried, i.e., during a so-called "standby period", the surface temperature of the heat rollers is controlled to fall to a temperature lower than the set temperature. When a photosensitive material is to be dried, the heat rollers are heated to the set temperature from the time the photosensitive material is inserted into the drying portion to the time when the photosensitive material contacts the heat rollers. When drying is completed, the temperature of the heat rollers is lowered to the predetermined temperature of the standby state.

However, when the surface temperature of the heat rollers is raised from the standby temperature to the set temperature and drying air is blown simultaneously, if the temperature of the drying air during the time the heat rollers are heating is less than the set temperature of the heat rollers, the raising of the surface temperature of the heat rollers is disturbed. Namely, the slope of the rate of change of temperature is small.

On the other hand, when the surface temperature of the heat rollers is lowered from the set temperature to the standby temperature, if the supply of drying air, whose temperature is lower than the surface temperature of the heat rollers, is continuous, the surface temperature of the heat rollers will decrease quickly. If the next photosensitive material is sent into the drying device in a short interval, it takes time for the surface temperature of the heat rollers to return to the set temperature. If the set temperature of the drying air is even lower than the standby temperature of the heat rollers, even more time is required.

Namely, although it is ideal for the temperature raising time of the heat rollers to be fast and the lowering time to be slow, the drying air produces the opposite effect. Therefore, operational efficiency deteriorates in so far as the drying time is lengthened (the interval becomes longer), and the like.

As advances have been made in the field of electronics, image processing has become more diverse. Due to the effects of electronics on image processing, an image can be converted into an electric signal (e.g., a digital signal), various processes can be effected quickly by a computer or the like, and recording can be effected onto various recording media.

Along with the diversification of image processing, processing can be effected rapidly in the field of silver halide photography as well. The demand for rapid processing has strongly increased especially with regard to photosensitive materials such as those used for graphic arts and X-rays. As a result, various photosensitive material processing apparatuses which can rapidly process photosensitive materials have been studied and implemented. In particular, photosensitive material drying apparatuses have been studied in which a photosensitive material, which has undergone processing by processing solutions such as developing solution, fixing solution, and washing solution, is finished rapidly and with high quality.

As image processing has become more rapid, photosensitive materials, which are compatible with rapid processing, and processing solutions (such as fixing solution and the like) for processing such photosensitive materials have been developed. A trend with respect to this type of photosensitive material or to photosensitive materials processed by this type of processing solutions is to make the membrane surface of the photosensitive material more thin and suppress hardening thereof in order to achieve the requisite quality in a short time. This trend takes into account only developing and fixing processes.

However, it is known that when the photosensitive material is dried, the thickness of the membrane of the photosensitive layer and the existence of a hard membrane layer on the surface of the photosensitive layer effect the processing time. In order to shorten the drying time, the membrane surface of the photosensitive material which has been processed by processing solutions may be hardened. This suppresses the swelling of the emulsion applied to the photosensitive material so that the dryability of the photosensitive material can be improved. Namely, in order for a photosensitive material to be dried quickly, it is preferable that the membrane surface thereof be hardened, either by processing solutions (fixing solution in particular), or due to the photosensitive material itself having a hard membrane surface.

Reciprocating phenomena exist within each processing stage of rapid processing. Diversifying the combinations of types of photosensitive materials and processing solutions for processing the photosensitive materials leads to a wide range of differences in the work the photosensitive material drying apparatus must perform when a photosensitive material is dried. As a result, when photosensitive materials are subject to drying processing under the same conditions, the heat loss due to heating the photosensitive material is often large. When the heat within the drying apparatus is exhausted, it is generally discharged to the exterior of the apparatus. As the discharged heat adversely effects the operating environment of the operator in the vicinity of the photosensitive material drying apparatus, it is preferable to control this phenomenon.

Further, in order for the photosensitive material to be optimally finished by the drying apparatus, at least overheating should be avoided. Especially with photosensitive materials such as film or the like, it is also preferable that there is dimensional stability of the finished photosensitive material. For example, a film may be formed having a polyester base as a supporting body. On one surface thereof, an emulsion layer is applied, and on the other surface thereof, a backing layer of gelatine and dye is formed. With such a film, if the dimensions thereof at the time of exposure and the dimensions thereof after drying are the same, there is no problem if the film expands or contracts in the intermediate processes. However, when the film absorbs much moisture in the developing process and the like, drying is not effected under the appropriate conditions. The emulsion layer and the backing layer including gelatine thereby lose their ability to expand and contract, and substantially only expansion of the supporting body is observed.

When the film is dried, the respective contractions of the emulsion layer, the backing layer, and the supporting body are different. In addition, the supporting body limits the contraction of the emulsion layer and the backing layer. For these reasons, the film is often maintained in a state in which the emulsion layer and the backing layer have expanded more than the supporting body.

SUMMARY OF THE INVENTION

With the aforementioned in view, an object of the present invention is to provide a photosensitive material drying method and apparatus in which, in drying processing using heat rollers, a temperature of outer circumferences of the heat rollers is low so that the safety of the operator is not jeopardized, and so that, even if the photosensitive material is stopped in vicinities of the heat rollers, overdrying does not occur. The photosensitive material drying method and apparatus are efficient and relatively rapid.

Further, another object of the present invention is to provide a method of and an apparatus for controlling temperature of a photosensitive material drying apparatus in which, when a surface temperature of heat rollers is raised and lowered, the temperature is controlled so that the raising of the temperature is rapid and the lowering of the temperature is slow so that efficiency in drying can be improved.

Moreover, another object of the present invention is to provide a control method for a photosensitive material drying apparatus and a photosensitive material drying apparatus in which drying processing of the photosensitive material is effected in accordance with processing conditions contingent upon the processing solutions so that the photosensitive material can be dried under optimal conditions, thereby suppressing loss of heat used to heat the photosensitive material.

The first aspect of the present invention is a photosensitive material drying method for drying a photosensitive material conveyed along a conveying path, comprising the steps of: bringing both surfaces of the photosensitive material alternately into contact with outer circumferential surfaces of a plurality of heat rollers heated by heat sources; heating the photosensitive material by an amount of heat provided on a basis of a temperature of the outer surfaces of the heat rollers and on the basis of contact time of the photosensitive material and the heat rollers; and evaporating moisture from a surface of the photosensitive material not contacting the heat rollers.

In accordance with the first aspect, the amount of heat applied to the photosensitive material by the heat rollers can be obtained based on the temperature of the outer circumferential surfaces of the heat rollers and on the contact time between the heat rollers and the photosensitive material. Namely, the drying ability is determined by the product of the surface temperature of the heat rollers and the contact time. Therefore, by increasing the amount of photosensitive material stuck around the heat rollers, the contact time is increased without slowing the conveying speed so that even if the temperature of the outer circumferences of the heat rollers is lowered, high-quality drying can be effected. As a result, even if paper or film jams and the photosensitive material remains in the vicinities of the heat rollers, over-drying can be prevented because the temperature of the outer surfaces of the heat rollers is low. Damage, such as wrinkling and deformation, to the photosensitive material is thereby prevented.

A second aspect of the present invention is a photosensitive material drying apparatus for drying a photosensitive material conveyed along a conveying path, comprising: a first heat roller equipped with a heat source in an interior portion of the first heat roller, the photosensitive material being stuck around the first heat roller such that one surface of the photosensitive material contacts a portion of the circumferential surface of the first heat roller; a second heat roller equipped with a heat source in an interior portion of the second heat roller, the photosensitive material being stuck around the second heat roller such that another surface of the photosensitive material contacts a portion of the circumferential surface of the second heat roller; a chamber having an opening in the vicinity of the conveying path, the opening being provided along a transverse direction of the photosensitive material and facing the outer surface of the photosensitive material which is conveyed while stuck around the first heat roller and the second heat roller; and drying air supplying means for supplying drying air into the chamber.

In accordance with the second aspect, the first heat roller heats the emulsion surface of the photosensitive material. Accordingly, evaporation at the back surface begins and is promoted by drying air supplied to the chamber by a drying air supplying means.

Further, when the back surface of the photosensitive material is heated by the second heat roller, evaporation at the emulsion surface begins and is promoted by the drying air.

Because the photosensitive material is stuck around the first heat roller and the second heat roller, the photosensitive material is heated for a time which corresponds to the amount by which the photosensitive material is stuck around the heat rollers. Accordingly, even if the temperature of the first heat roller and the second heat roller is lowered, the lowering of temperature is compensated for by an extension of time (i.e., by extending the time during which the photosensitive material contacts the first heat roller and the second heat roller). Therefore, appropriate drying processing can be effected.

Even if the photosensitive material becomes jammed and is stopped while stuck around the first and/or second heat rollers, the quality of the photosensitive material can be maintained without the photosensitive material wrinkling and the like due to heating of certain portions thereof.

Further, the temperature of the heat rollers in the present aspect is much lower than the temperature of conventional heat rollers (100° C. to 150° C.) between which the photosensitive material is held and conveyed in a straight line. Therefore, in the present aspect, the safety of the operator is not jeopardized during maintenance, and the maintenance workability can be improved.

A third aspect of the present invention is a method of controlling a surface temperature of a heat roller in a photosensitive material drying apparatus in which a photosensitive material which has been processed by processing solutions is conveyed in sticking on the heat roller whose surface temperature is controlled to a predetermined temperature, and in which drying air is blown to an outer surface of the heat roller so as to promote evaporation of moisture on the surface of the photosensitive material stuck on the outer surface of the heat roller, comprising a step of: stopping blowing of the drying air during a period in which the surface temperature of the heat rollers is raised from a standby temperature lower than the predetermined temperature to the predetermined temperature so as to increase the rate of change of the surface temperature of the heat rollers.

A fourth aspect of the present invention is an apparatus for controlling surface temperature of a heat roller which conveys and dries a photosensitive material trained around an outer surface of the heat roller, comprising: drying air supplying means equipped with blow-out openings provided along a conveying path and supplying drying air to the photosensitive material; and drying air supply controlling means for stopping supply of the drying air by the drying air supplying means during a period in which the surface temperature of the heat roller is raised from a standby temperature lower than a predetermined temperature to the predetermined temperature.

In accordance with the third and fourth aspects, the surface temperature of the heat rollers is controlled to a set temperature. The photosensitive material, which has been processed by processing solutions, is conveyed while contacting the heat rollers. As an example, several heat rollers are provided so as to be spaced apart from each other. Front and rear surfaces of the photosensitive material are successively trained around the heat rollers at a predetermined angle, and the photosensitive material is conveyed in this state.

By heating the surface contacting the heat roller, the moisture in the opposite surface, i.e., the non-contacting surface, evaporates. Drying air is blown to the non-contacting surface so as to promote evaporation.

The surface temperature of the heat rollers is controlled to a set temperature while the drying of the photosensitive material continues. However, when the photosensitive material is not being conveyed, the surface temperature of the heat rollers is controlled to a standby temperature lower than the set temperature in order to conserve electric power. As an example, the temperature is raised to the set temperature in the interval between the time when processing of the photosensitive material by processing solutions in the developing apparatus begins to the time when the photosensitive material enters the drying apparatus.

Namely, the drying air impedes the raising of the temperature of the heat rollers. The temperature of the drying air is lower than that of the heat rollers during the raising of the temperature of the heat rollers, e.g., when the starting-up of the heater which heats the drying air slow. Accordinaly, the temperature of the drying air during drying is not always related to the raising of the temperature of the heat rollers.

The blowing of the drying air, which impedes the raisins of the surface temperature of the heat rollers, stopped during the time the surface temperature of the heat rollers is being raised from the standby temperature to the predetermined temperature. Accordingly, because the heat from the surfaces of the heat rollers is not decreased by the drying air, the rate of change in the raising of the surface temperature is large so that the surface temperature can be raised to the set temperature in a short time.

A fifth aspect of the present invention is a method of controlling surface temperature of a heat roller in a photosensitive material drying apparatus in which a photosensitive material is conveyed while contacting the heat roller, and in which drying air is blown to a surface of the photosensitive material not contacting the heat rollers so as to promote evaporation of moisture, comprising a step of: stopping blowing of the drying air during a period in which the surface temperature of the heat rollers is lowered from a predetermined temperature to a standby temperature lower than the predetermined temperature so as to decrease the rate of change of temperature of the surface temperature of the heat rollers.

A sixth aspect of the present invention is an apparatus for controlling surface temperature of a heat roller in a photosensitive material drying apparatus in which a photosensitive material is conveyed while contacting the heat roller and in which drying air is blown to a surface of the photosensitive material not contacting the heat roller so as to promote evaporation of moisture, comprising: drying air supplying means equipped with blow-out openings provided along a conveying path and supplying drying air to the photosensitive material; and drying air supply controlling means for stopping supply of the drying air by the drying air supplying means during a period in which the surface temperature of the heat rollers is lowered from a predetermined temperature to a standby temperature lower than the predetermined temperature.

In accordance with the fifth and sixth aspects of the present invention, when the surface temperature of the heat rollers is lowered from a predetermined temperature to the standby temperature, if the supply of drying air is continuous, the drop in the temperature is accelerated, compared to a case in which the surface temperature is lowered by natural cooling by turning the heaters off. Therefore, if it becomes necessary to dry a photosensitive material while the temperature is being lowered, the temperature cannot quickly be raised to the set temperature.

As a result, when the surface temperature of the heat rollers is lowered from the predetermined temperature to the standby temperature, the blowing of the drying air, which promotes the drop in the surface temperature, is stopped. In this way, the drop in temperature is gradual. If, during the lowering of the temperature, it becomes necessary to raise the temperature to the set temperature again, the temperature can be raised to the set temperature in a short time.

A seventh aspect of the present invention is a method for controlling a photosensitive material drying apparatus equipped with main drying means for heating a photosensitive material, a subordinate drying means for blowing drying air to photosensitive material, and a measuring means for measuring a humidity and/or a temperature of an operating environment, comprising a step of: controlling a heating temperature of the main drying means and an amount of drying air blown out from the subordinate drying means in accordance with a type of photosensitive material, types of processing solutions which process photosensitive material, the humidity and/or the temperature measured by the measuring means.

In the method of controlling a photosensitive material drying apparatus of the seventh aspect, the type of photosensitive material, the types of processing solutions, and the humidity of the operating environment or the temperature and the humidity of the operating environment are used as conditions during drying of the photosensitive material. The heating temperature of the photosensitive material by the main drying means, which is set in advance at the photosensitive material drying apparatus, and the amount of drying air, which is generated by the subordinate drying means, are controlled in accordance with this data.

The type of the photosensitive material may be based on the thickness of the membrane of the photosensitive layer, the existence of a hard membrane in the photosensitive layer and the like. The types of the processing solutions are not based only on the developing and fixing solutions, which are the main solutions used in processing. Whether there is a hardener in the fixing solution is an important factor in the drying of the photosensitive material.

In a case in which the photosensitive material does not harden, the photosensitive material can be dried in a short time by a large amount of drying air. Further, when the photosensitive material hardens, the amount of drying air is decreased so that the photosensitive material can be dried gradually.

In addition, taking into account the temperature and the humidity, particularly the humidity, of the operating environment when the photosensitive material is processed, the amount of moisture contained in the finished photosensitive material is close to the amount of moisture contained therein before exposure. The dimensional stability of the photosensitive material can thereby be maintained.

An eighth aspect of the present invention is a photosensitive material drying apparatus, comprising: input means for inputting type of photosensitive material and data regarding processing solutions which process the photosensitive material; environment measuring means for measuring a temperature and a humidity or a humidity of the environment; drying means for heating the photosensitive material and blowing drying air to the photosensitive material so as to dry the photosensitive material; and a control portion for controlling a heating temperature at which the drying means heats the photosensitive material and an amount of drying air of the heating means in accordance with data from the input means and the environment measuring means.

In the photosensitive material drying apparatus of the eighth aspect, when the type of photosensitive material and the types of processing solutions are input by the inputting means, the humidity of the operating environment or the temperature and the humidity of the operating environment are measured by the measuring means, The heating temperature at which the main drying means heats the photosensitive material and the amount of drying air generated by the subordinate drying means are controlled. In this way, the photosensitive material can be dried under optimal conditions. Further, because the heating temperature and the amount of drying air are controlled, the heat loss of the heating means is reduced, and exhaust from the photosensitive material drying apparatus to the exterior thereof can be suppressed.

It is preferable that means such as infrared heaters, heat rollers and the like, whose temperatures are controlled more easily than that of the drying air, be used as the heating means of the present aspect. The drying air can be set to a predetermined temperature by a fan and a heater, or air from outside the apparatus may be supplied by a fan. Alternatively, air within the apparatus may be discharged and air from the outside may be supplied naturally, or any combination of these systems may be used.

As described above, in the photosensitive material drying method and apparatus of the first and second aspects of the present invention, in drying processing using heat rollers, high-quality drying can be effected in a small space and with little electric power as compared to existing techniques involving drying by hot air. Further, in the first and second aspects, the temperature of the outer circumferences of the heat rollers is relatively low and the quality of the images is not adversely effected. Efficient drying can be effected, and the dimensions of the film can be held stable. A superior effect is achieved in that, even if the conveying of the photosensitive material is stopped in the vicinities of the heat rollers, the surface temperature of the heat rollers is low so that overdrying does not occur.

In the temperature controlling method and apparatus of a photosensitive material drying apparatus relating to the third through the sixth aspects of the present invention, during raising and lowering of the surface temperature of the heat rollers, temperature control is effected such that the raising time is rapid and the lowering time is slow. A superior effect is achieved in that drying workability can be improved.

In the controlling method of a photosensitive material drying apparatus related to the seventh aspect of the present invention, the drying temperature of the photosensitive material and the amount of drying air are set based on the photosensitive material, data regarding the processing solutions and the temperature and humidity of the operating environment, Accordingly, photosensitive materials having greatly different dryabilities can be finished under optimal drying conditions.

Further, in the photosensitive material drying apparatus relating to the eighth aspect of the present invention, the photosensitive material is dried in accordance with the type of the photosensitive material and the types of the processing solutions which process the photosensitive material, so that the photosensitive material can be dried under optimal conditions. A superior effect is achieved in that the heat and the amount of drying air during drying are kept to minimum values so that the discharge of heat is reduced and so as to provide a good operating environment for the workers.

DESCRIPTION OF THE PREFERRED EMBODIMENTS

Figure 1:
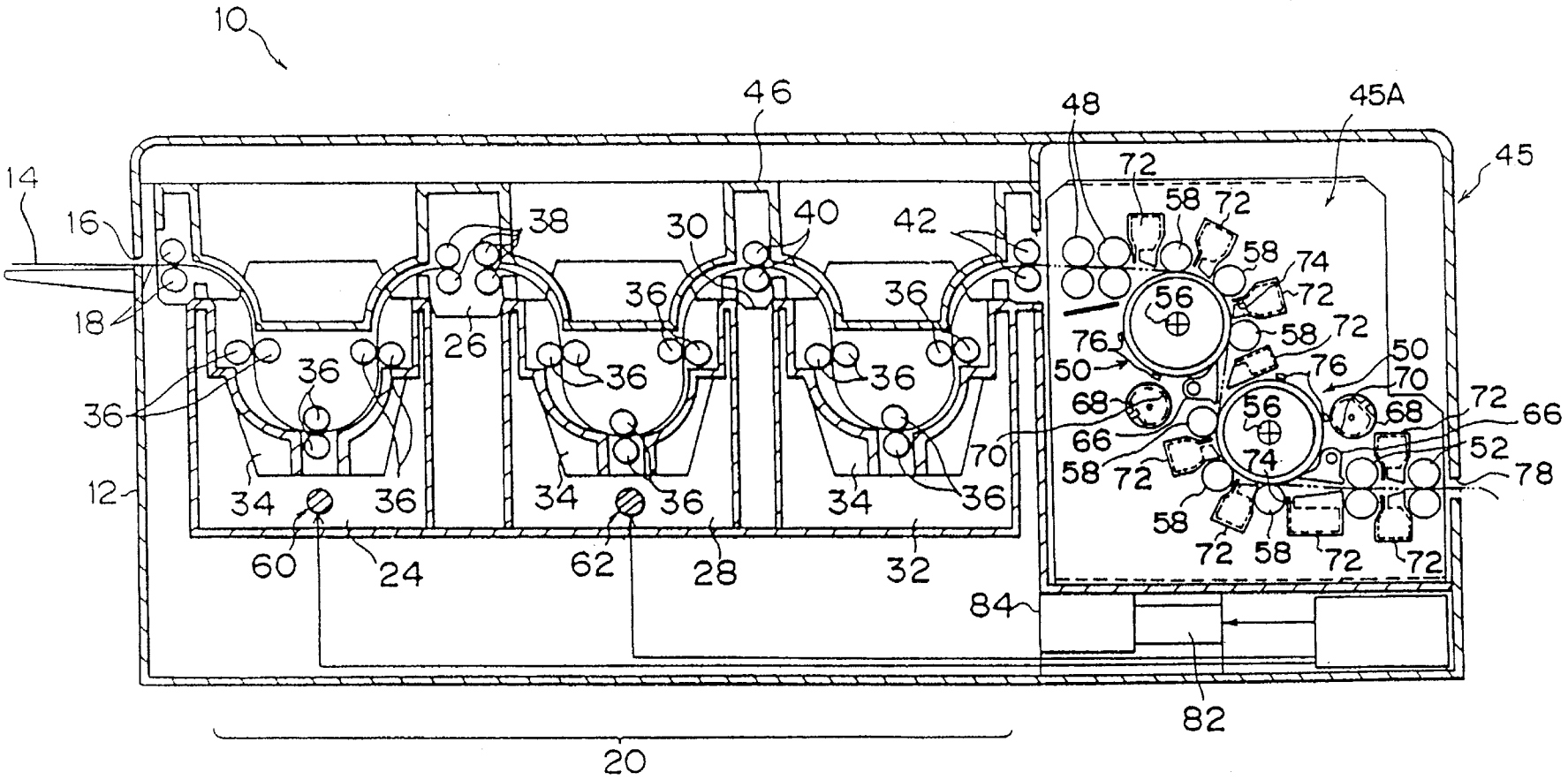
FIG. 1 is a schematic structural view illustrating an automatic developer relating to a first embodiment.

A first embodiment of the present invention will now be described. FIG. 1 illustrates a schematic structural view of an automatic developer 10 which is a photosensitive material processing apparatus.

An insertion opening 16, through which a photosensitive material 14 is inserted, is provided in the left side surface in FIG. 1 (the upstream side end portion) of a casing 12 of the automatic developer 10. A pair of rollers 18 are provided at the interior side of the insertion opening 16 and are rotated by an unillustrated driving means. As a result, the photosensitive material 14 inserted from the insertion opening 16 is guided by the driving force of the pair of rollers 18 to a processing portion 20 disposed at an interior portion of the automatic developer 10.

A developing tank 24, a rinsing tank 26, a fixing tank 28, a rinsing tank 30 and a washing tank 32 are provided in the processing portion 20 in that order from the left side of FIG. 1. Developing solution, fixing solution and washing solution are stored in the developing tank 24, the fixing tank 28 and the washing tank 32, respectively (hereinafter, these tanks will be referred to generically as "processing tanks"). Further, wash water (e.g., water or acetic acid aqueous solution) is supplied from an unillustrated storage tank by a pump through piping to the rinsing tank 26. Wash water (e.g., water) is supplied to the rinsing tank 30 in the same manner. The excess wash water overflows from the rinsing tanks 26, 30 to unillustrated overflow tanks. When water is used as the wash water, pipes leading from waterworks to the rinse tanks 25, 30 via direct solenoid valves may be provided so that storage tanks are not used. Tap water is thereby supplied to the rinsing tanks 25, 30.

A rack 34 is provided in each of the processing tanks 24, 28, 32. A plurality of pairs of rollers 35, between which the photosensitive material 14 is interposed and which convey the photosensitive material 14 along a prescribed conveying path, is provided in each of the processing tanks 24, 28, 32. Crossover racks 46 equipped with rinse racks are disposed above the processing tanks. Rollers 38, 40 are provided in the crossover racks 46 above the rinsing tanks 26, 30. The photosensitive material 14 is interposed between the rollers 38, 40 and is guided to the adjacent processing tank, and processing solution adhering to the photosensitive material 14 is removed by the rollers 38, 40.

Heaters 60, 62 are disposed in the developing tank 24 and the fixing tank 28, respectively. The heaters 60, 62 are each formed of a stainless alloy (e.g., SUS316) pipe-shaped body and a coil-shaped heater main body (unillustrated) serving as a heat source which is accommodated within the pipe-shaped body. The heaters 60, 62 are inserted from the side walls of the processing tanks 24, 28 into the processing tanks 24, 28. The developing solution and the fixing solution are heated by the heaters 60, 62. When the automatic developer 10 is being started up, the heaters 60, 62 heat the solutions to temperatures at which processing of the photosensitive material 14 is possible. After start-up, the temperatures at which processing of the photosensitive material 14 is possible are maintained.

The photosensitive material 14 which has undergone washing processing in the washing tank 32 is conveyed by a pair of conveying rollers 42 to a drying portion 45 which is adjacent the processing portion 20. The photosensitive material 14, which has been washed by the wash water, is subject to drying processing in the drying portion 45.

Figure 2:
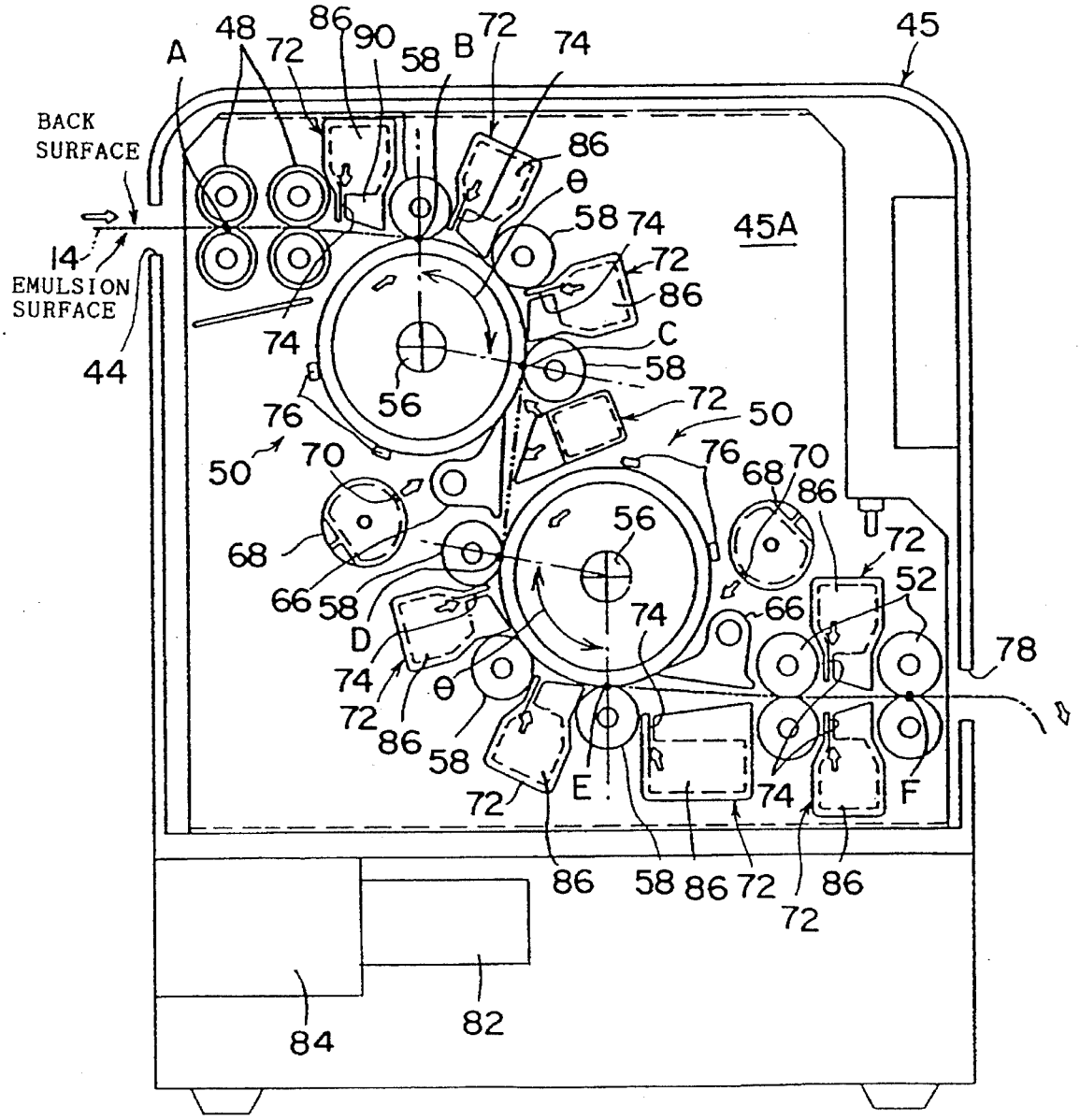
FIG. 2 is an enlarged view of a drying portion.

As illustrated in FIG. 2, the photosensitive material 14 is inserted into a drying chamber 45A of the drying portion 45 from a drying chamber insertion opening 44. Squeeze rollers 48, two heat rollers 50, 50, and discharge rollers 52 are provided in the drying chamber 45A along the conveying path of the inserted photosensitive material 14, and are suspended between and axially supported by a pair of side plates 64. Driving force from an unillustrated driving means is transmitted to the squeeze rollers 48, the heat rollers 50 and the discharge rollers 52 so that the photosensitive material 14 is conveyed at a constant speed.

While the photosensitive material 14 is interposed between and conveyed by the squeeze rollers 48, moisture adhering to the surfaces of the photosensitive material 14 is squeezed therefrom. The photosensitive material 14 is guided by a guide 72 disposed downstream of the squeeze rollers 48 to the outer circumference of one of the heat rollers 50.

The two heat rollers 50 are disposed substantially vertically so that the photosensitive material 14 is trained about the respective outer circumferential surfaces thereof.

As illustrated in FIG. 2, it is preferable that an angle at which the photosensitive material 14 is trained around the heat roller 50, i.e., an angle θ from the point at which the training of the photosensitive material 14 begins (points B and D in FIG. 2) to the point at which the training ends (points C and E in FIG. 2) is substantially 90 degrees.

Figure 3:
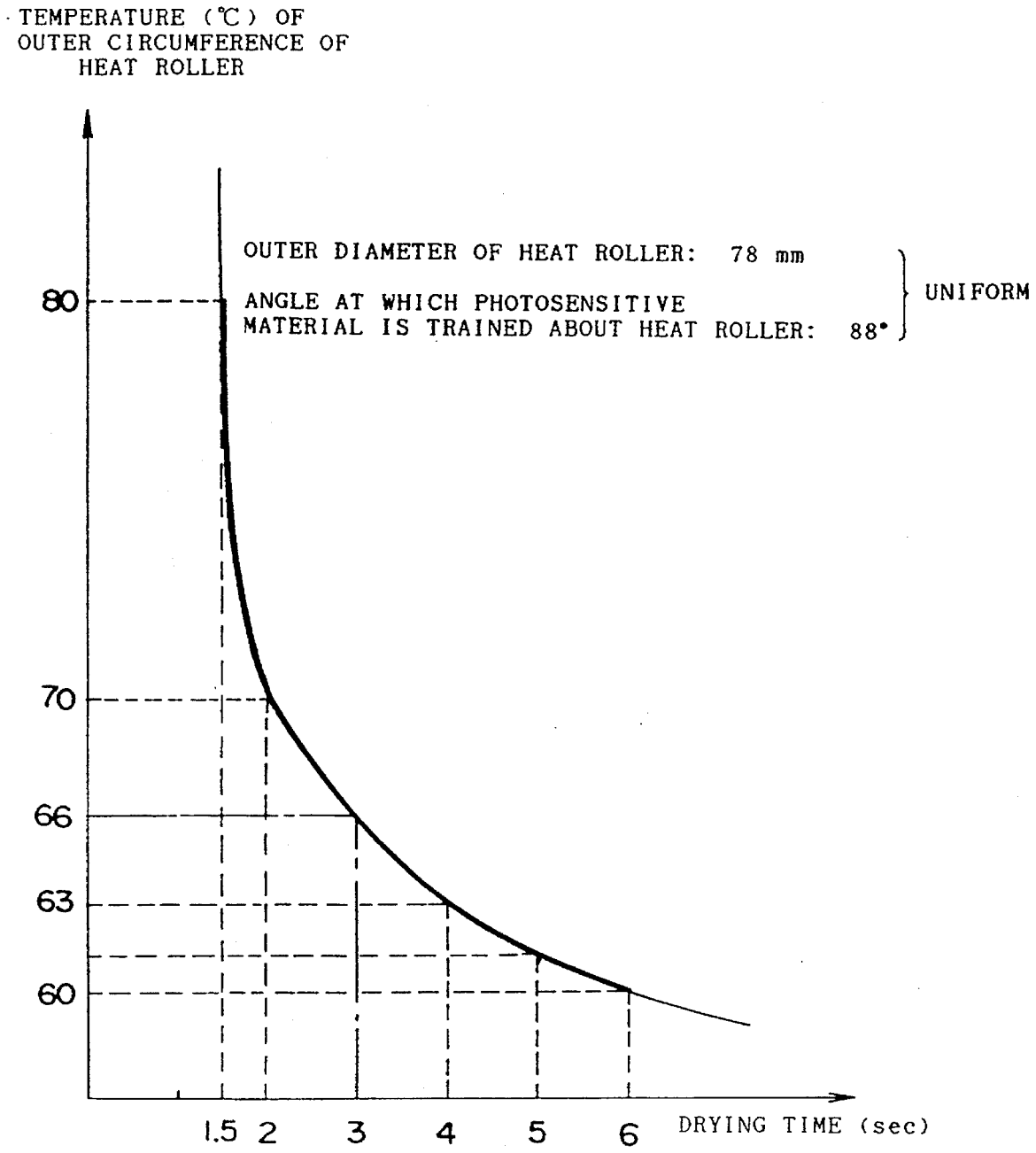
FIG. 3 is a characteristic view illustrating a relationship between the time of contact between a photosensitive material and a heat roller on the one hand, and a temperature of an outer circumference of the heat roller, on the other hand.

The angle θ is set such that a predetermined time of contact with the heat roller 50 can be obtained based on the outer diameter of the heat roller 50 and the rotational speed thereof (the conveying speed of the photosensitive material). Further, a value based on this contact time and the outer circumferential temperature of the heat roller 50 is the amount of heat applied to the photosensitive material 14. Accordingly, as illustrated in FIG. 3, at an angle θ of approximately 90 degrees as in the present embodiment, the outer circumferential temperature of the heat roller 50 is set to 70° C., appropriate heating processing is effected in a drying time of 2 seconds.

The heat rollers 50 are cylindrical. A heating source 56, which is formed by a halogen lamp or the like and which heats the outer peripheral portion of the heat roller 50, is coaxially disposed at an axially central portion of each of the heat rollers 50. The outer circumference of the heat roller 50 is heated by the heat source 56.

A plurality of nip rollers 58 is disposed at the periphery of the heat roller 50 so that the photosensitive material 14 trained around the heat roller 50 is interposed between the outer circumferential surface of the heat roller 50 and the nip rollers 58. The photosensitive material 14 contacts the outer peripheral surface of the heat roller 50, which is heated by the heat source 56, and is heated by heat conduction from the heat roller 50.

For example, an experiment was performed in which the diameter of the beat roller 50 was 78 mm, the conveying speed of the photosensitive material 14 was 30 mm/sec, the contact time of the photosensitive material 14 with each of the heat rollers 50 was 2 seconds, the surface temperature of the heat rollers 50 was 70° C., and the training angle was 88 degrees. Ten photosensitive materials 14 of four-cut size were successively processed and dried, and satisfactory results were achieved.

A peeling guide 66 is disposed downstream of each of the heat rollers 50 in the conveying direction of the photosensitive material 14. One end of the peeling guide 66 contacts the outer circumferential surface of the heat roller 50, and the other end portion thereof is axially supported by the side plates 64. The peeling guide 66 peels the photosensitive material 14 trained around the heat roller 50 from the outer circumferential surface of the heat roller 50 at a prescribed position. Further, an intermediate portion of the peeling guide 66 projects toward the downstream side in the conveying direction of the photosensitive material 14 and guides the photosensitive material 14 peeled from the heat roller 50 toward the downstream side in the conveying direction.

The guides 72 are also disposed downstream of the respective heat rollers 50 and between the discharge rollers 52. The photosensitive material 14 being conveyed by the squeeze rollers 48, the heat rollers 50 and the discharge rollers 52 is guided to the downstream sides of these rollers by the respective guides 72.

The guide main body 86 of the guide 72 is a pipe-shaped body having a substantially rectangular cross section. One longitudinal direction end o]F the guide main body 86 is open such that an opening is formed thereat. The other end of the guide main body 86 is closed, and the interior thereof is hollow so that the guide main body 86 forms a chamber. The guide 72 is disposed such that the longitudinal direction of the guide main body 86 is the transverse direction of the photosensitive material 14 (a direction perpendicular to the surface of FIG. 2). The guide 72 is fixed to the side plates of the drying chamber (.this construction is unillustrated). A plurality of ribs 90 and a slit 74 are formed in the surface of the guide main body 86 which faces the conveying path of the photosensitive material 14. The ribs 90 are formed parallel to the conveying direction of the photosensitive material 14, and the slit 74 is formed along the longitudinal direction of the guide main body 86 (the transverse direction of the photosensitive material 14).

As illustrated in FIG. 2, blow-out pipes 68 having hollow interiors are provided in the drying chamber 45A at the sides opposite the sides at which the photosensitive material 14 is trained around the heat rollers 50. A slit 70 is formed in the surface of the blow-out pipe 68 on the side of the conveying path of the photosensitive material 14. The slit 70 is formed along the transverse direction of the photosensitive material 14 and communicates with the interior portion of the blow-out pipe 68. In the same way as the previously mentioned guides 72, drying air is supplied to the blow-out pipes 68 from a drying air supplying means.

Accordingly, the drying air supplied to the blow-out pipes 68 and the guides 72 is discharged toward the surface of the photosensitive material 14 from the slits 70, 74. Air containing much moisture in the vicinities of the surfaces of the photosensitive material 14 heated by the heat rollers 50 is removed by the drying air.

A fan 82 and a heater 84, which serve as a drying air supplying means, are provided beneath the drying chamber 45A. The fan 82 and the beater 84 generate drying air and supply the drying air to the blow-out pipes 68 and the guide main bodies 86 of the guides 72 via unillustrated ducts.

In the drying chamber 45A, temperature sensors 76 are disposed in vicinities of the outer circumferences of heat rollers 50. The surface temperature of the outer circumferential portions of the respective heat rollers 50 is measured by the temperature sensors 76. Namely, the heating temperature of the photosensitive material 14 is measured.

The photosensitive material 14 which has undergone drying processing in the drying chamber 45A is discharged from a discharge opening 78 to the exterior of the automatic developer 10.

Next, operation of the first embodiment will be described.

When the photosensitive material 14 is inserted into the interior of the automatic developer 10 from the insertion opening 16, the photosensitive material 14 is pulled in by the conveying rollers 18, is guided by the guide surface of the crossover rack 46, and is conveyed into the developing tank 24. In the developing tank 24, the photosensitive material 14 is interposed between the rollers 36 provided in the rack 34. While being conveyed through the developing solution in a substantially U-configuration, the photosensitive material 14 undergoes developing processing by the developing solution, and is then discharged to the downstream side.

The photosensitive material 14 discharged from the developing tank 24 is washed with wash water in the rinsing tank 26 while being conveyed by the rollers 38 of the rinsing tank 26. Thereafter, the photosensitive material 14 is guided by the guide surface of the crossover rack 46 so as to be conveyed to the fixing tank 28. In the fixing tank 28, the photosensitive material 14 is interposed between the rollers 36 provided in the rack 34. While being conveyed through the fixing solution in a substantially U-configuration, the photosensitive material 14 undergoes fixing processing by the fixing solution, and is then discharged to the downstream side.

The photosensitive material 14 discharged from the fixing tank 28 is washed with wash water while being conveyed by the rollers 40 in the rinsing tank 30. The photosensitive material 14 reaches the washing tank 32 and is conveyed by the rack 34 through the wash water so as to undergo washing processing. The developing solution and the fixing solution stored in the developing tank 24 and the fixing tank 28 respectively are heated by the heaters 60, 62 to predetermined temperatures at which processing of the photosensitive material 14 is possible, and are maintained at those temperatures.

After washing processing in the washing tank 32 has been completed for the photosensitive material 14, the photosensitive material 14 is inserted into the drying chamber 45A of the drying portion 45, is conveyed into the interior of the drying chamber 45A, and is subject to drying processing.

The photosensitive material 14 inserted in the drying chamber 45A is squeezed by the squeeze rollers 48, is guided by the ribs 90 of the guides 72, and is trained around the upstream side heat roller 50. The photosensitive material 14 is conveyed while trained around the heat roller 50, and is heated by heat which is transferred from the outer circumferential portion of the heat roller 50 heated by the heating source 56 to the interior of the photosensitive material 14 by heat conduction. Further, a portion of the drying air generated by the fan 82 and the heater 84 is blown from the guides 72 and the blow-out pipes 68 to the surface of the photosensitive material 14 which does not contact the heat roller 50, i.e., the back surface. As a result, moisture evaporates from the back surface of the photosensitive material 14.

Next, the photosensitive material 14 is trained around the downstream side heat roller 50. At this time, the back surface of the photosensitive material 14 is the surface which contacts the heat roller 50. As a result, the back surface is heated, and drying air is blown toward the emulsion surface side. While the evaporation of moisture from the emulsion surface side is promoted, the photosensitive material 14 is guided by the guides 72, is interposed between and conveyed by the discharge rollers 52, and is discharged to the exterior of the automatic developer 10 from the discharge opening 78.

Figure 4A:
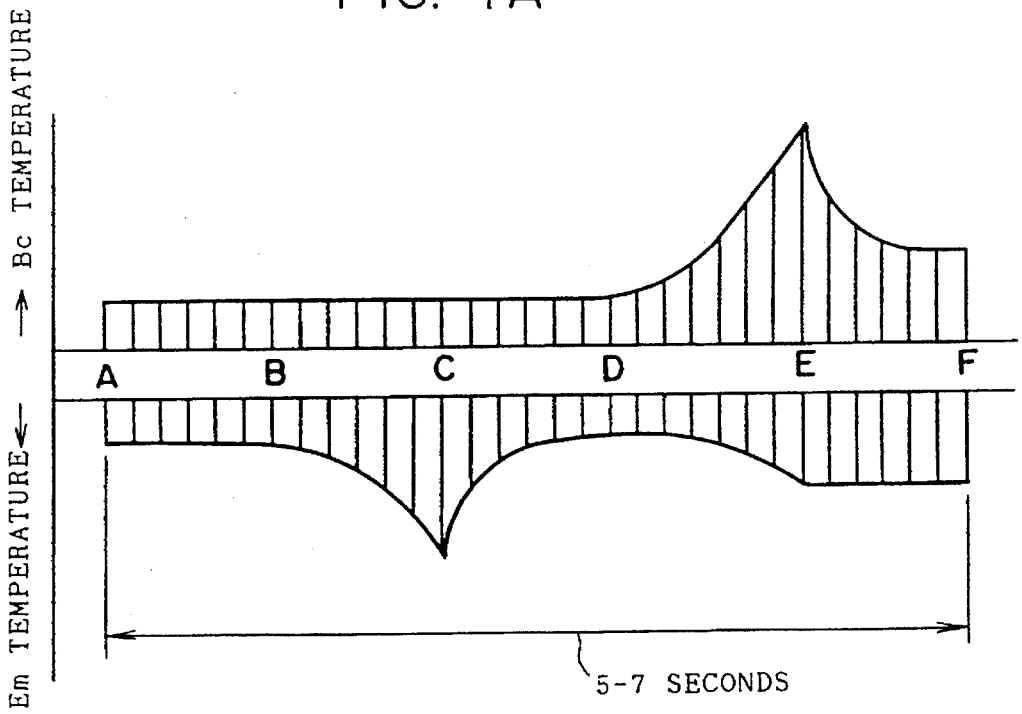
FIG. 4A is a view illustrating temperature distribution front and rear surfaces when the photosensitive material is being dried.
Figure 4B:
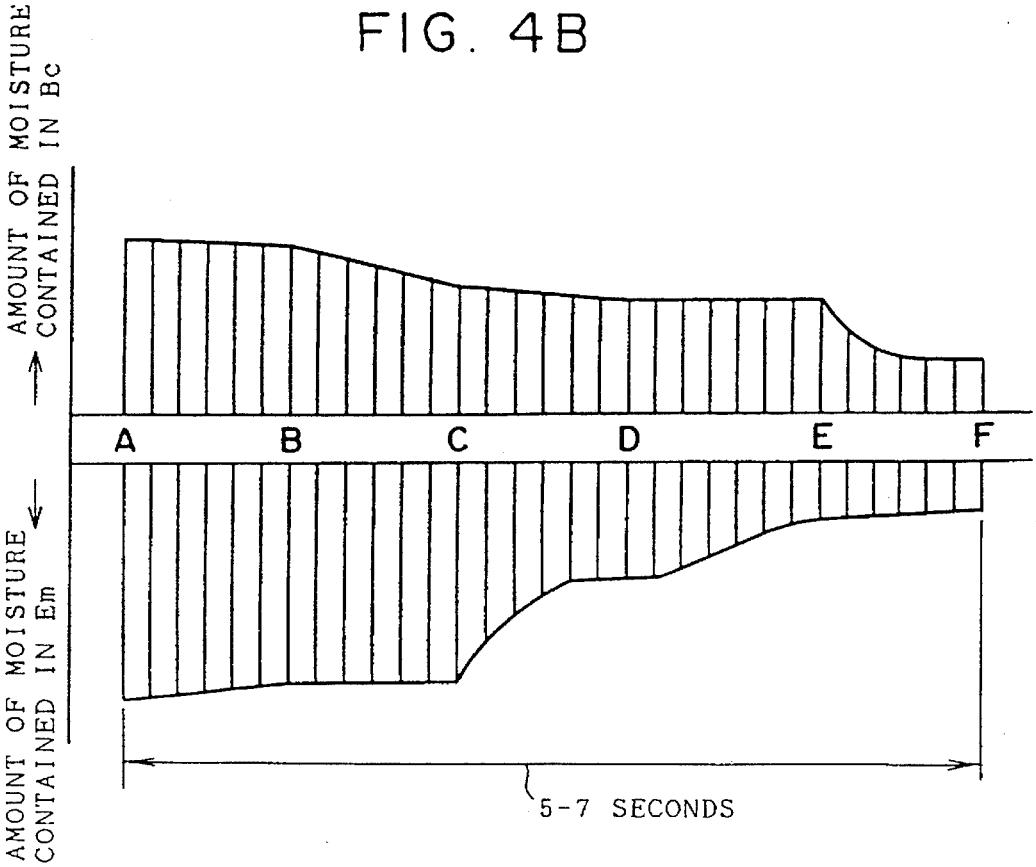
FIG. 4B is a view illustrating distribution of amounts of moisture contained in the front and rear surfaces when the photosensitive material is being dried.

FIG. 4A illustrates the temperature distribution of the photosensitive material 14 at each of the points A through F of FIG. 2. FIG. 4B illustrates the amount of moisture the photosensitive material 14 contains at each of the points A through F of FIG. 2.

Point A is a point before drying processing is effected. The temperatures of the Em surface (emulsion surface) and the Bc surface (back surface) are both low, and the respective moisture contents thereof are both high. At point B, because the Em surface contacts the heat roller 50, the temperature thereof gradually begins to rise. At another point slightly after point B, the amount of moisture the Bc surface contains gradually begins to decrease (beginning of moisture evaporation).

At point C, i.e., at the point in time at which the Em surface separates from the upstream heat roller 50, the temperature of the Em surface reaches its maximum and thereafter gradually decreases. At this time, the rate of decrease of the moisture content of the Em surface is greater than the rate of decrease of the moisture content of the Bc surface. This is due to the evaporation of the moisture from the high-temperature Em surface starting because the Em surface heated by the heat roller 50 separates from the heat roller 50.

At point D, because the Bc surface is trained around the downstream heat roller 50, the temperature of the Bc surface gradually rises. At this time, evaporation of moisture of the Em surface, which does not contact the heat roller 50, begins, and the amount of moisture contained therein gradually decreases.

When the photosensitive material 14 reaches point E, the temperature of the Bc surface reaches its maximum, and the photosensitive material 14 separates from the heat roller 50. Therefore, there is much evaporation from the Bc surface from point E to point F.

When the photosensitive material 14 reaches point F, the temperatures and moisture contents of the Em surface and the Bc surface are substantially uniform. Moisture evaporates equally from both front and rear surfaces of the photosensitive material 14.

As described above, by training the front and rear surfaces of the photosensitive material 14 alternately around the pair of heat rollers 50, the front and rear surfaces can be dried uniformly. Curls and the like which result from lack of uniformity in the drying of the front and rear surfaces can thereby be prevented.

In the apparatus of the present invention, image quality and dimensional stability are maintained with the 80° C. being the maximum limit of the surface temperature of the heat rollers 50. However, if the surface temperature is too low, the drying time is extended. By taking into account that the entire drying time is approximately four times the contact time between the photosensitive material 14 and the heat roller 50, and by considering a practical conveying speed of the photosensitive material 14 at which the photosensitive material 14 can be conveyed stably, it is preferable in the construction of the present invention that the contact time between the photosensitive material 14 and the heat roller 50 is 1.5 to 5 seconds for each heat roller 50.

Table 1 illustrates the relationship between contact times and surface temperatures of the heat rollers 50 compatible with the contact times.

TABLE 1

| | | | | | |
|---|---|---|---|---|---|
| Contact time t (sec) with one heat roller | 1.5 | 2 | 3 | 4 | 5 |
| Total drying time T (sec) | 6 | 8 | 12 | 16 | 20 |
| Surface temperature D (°C.) of heat rollers | 80 | 70 | 66 | 63 | |

With reference to Table 1, a conventional apparatus (drying by hot air) and the present embodiment (drying by training about heat rollers) are compared in subsequent Table 2.

TABLE 2

| | Drying by hot air | Heat rollers | Explanation of symbols |
|---|---|---|---|
| Energy efficiency | x (70% or more of discharged air is wasted) | ○ | ○ → optimal<br>Δ → regular<br>x → poor |
| Stability | ○ | ○ | |
| Performance | | | |
| (Drying ability) | x | ○ | |
| (Drying time) | x | ○ | |
| (Dimensional stability) | Δ to ○ | ○ | |
| Ability to be made compact (volume) | x | ○ | |
| Compatibility with rapid drying processing | x (improved capacity needed) → enlarge apparatus | ○ | |
| ex) Comparison of Conventional Apparatus and Apparatus of the Present Embodiment | | | |
| Electric power used by heater | 3.0 KW | 1.0 KW | |
| Electric power used by fan | 250 W | 45 W | |
| Volume ratio | 1 | 0.3 | |
| Drying time | 11 seconds | 5 to 7 seconds | |

As can be seen in Table 2, compared with hot air drying, heat roller drying is suitable for the photosensitive material 14 with respect to almost all of the items such as energy efficiency, stability, performance and the like. Further, the drying portion 45 can be made compact so that the entire apparatus can be made more compact.

Moreover, in the conventional apparatus, the drying time is 11 seconds, but in the present embodiment, the photosensitive material is dried in 5 to 7 seconds although the heater and the fan use little electric power. Therefore, in the present embodiment, the processing time can be shortened, and work efficiency improves.

In accordance with the present embodiment, the temperature of the outer circumference of the heat roller 50 is low, and the photosensitive material 14 is trained therearound at a predetermined angle. Therefore, even if the temperature of the outer circumference of the heat roller 50 is low, the photosensitive material 14 can be heated properly and reliably. As a result, there is a high degree of safety for the operator during maintenance of the apparatus, and the maintenance workability thereof improves.

Further, even if the photosensitive material 14 becomes jammed in the vicinity of the heat rollers 50, overdrying does not occur in a short time, and the photosensitive material 14 is therefore not damaged.

Next, a second embodiment of the present invention will be described. An automatic developer 99 of the second embodiment basically has the same structure as that of the automatic developer 10 of the first embodiment. However, as portions of the structures and control systems differ, the following explanation will focus on the differences. Further, parts used in the second embodiment which are the same as those used in the first embodiment are denoted by the same reference numerals, and description thereof is omitted.

Figure 5:
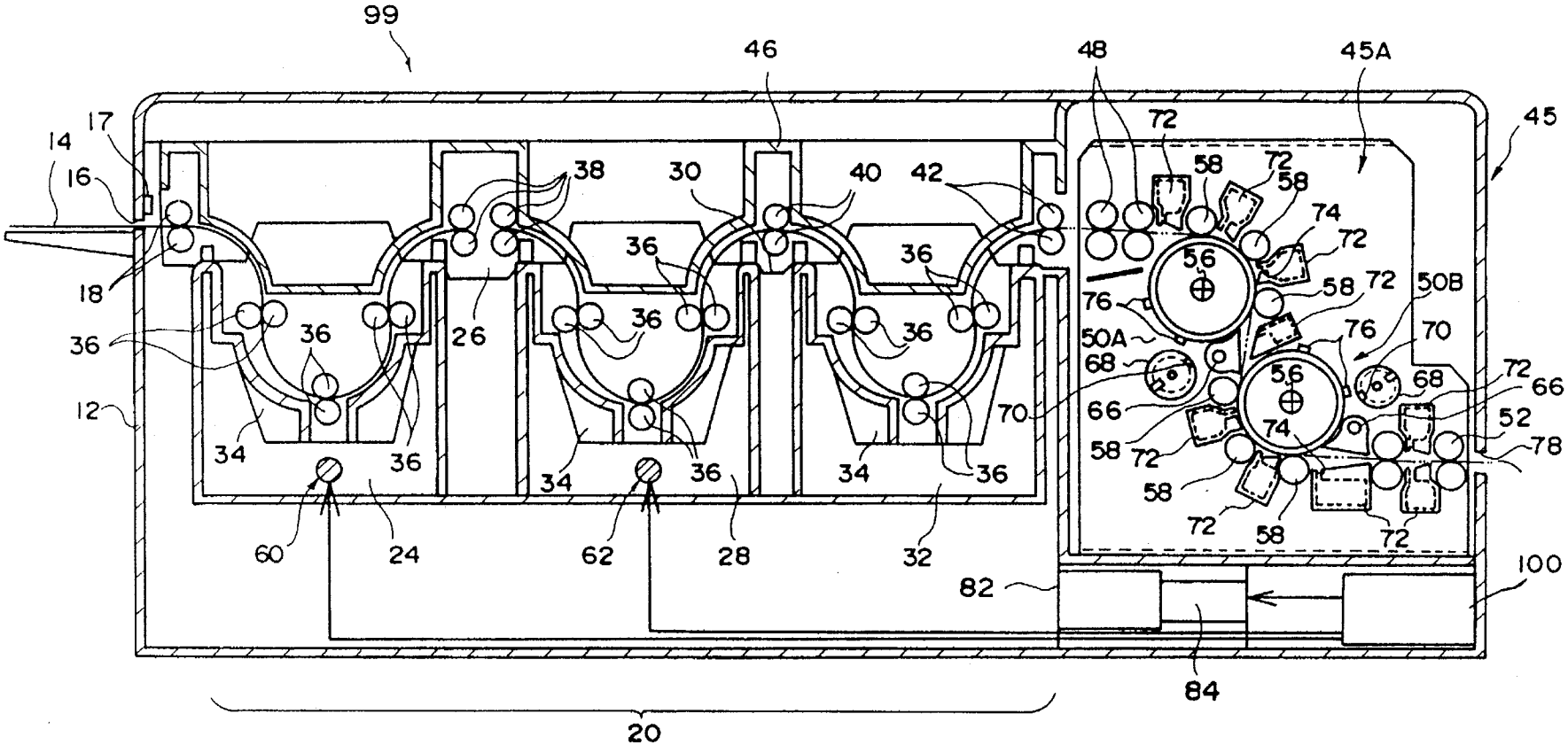
FIG. 5 is a side view illustrating a schematic structure of a photosensitive material processing apparatus relating to a second embodiment.

FIG. 5 is a schematic structural view of the automatic developer 99 which is a photosensitive material processing apparatus.

The insertion opening 16, through which the photosensitive material 14 is inserted, is provided in the left side surface in FIG. 5 (the upstream side end portion) of the casing 12 of the automatic developer 99. A sensor 17 which detects the existence of the photosensitive material 14 is provided in a vicinity of the insertion opening 16. The signal line of the sensor 17 is connected to a control portion 100.

Figure 6:
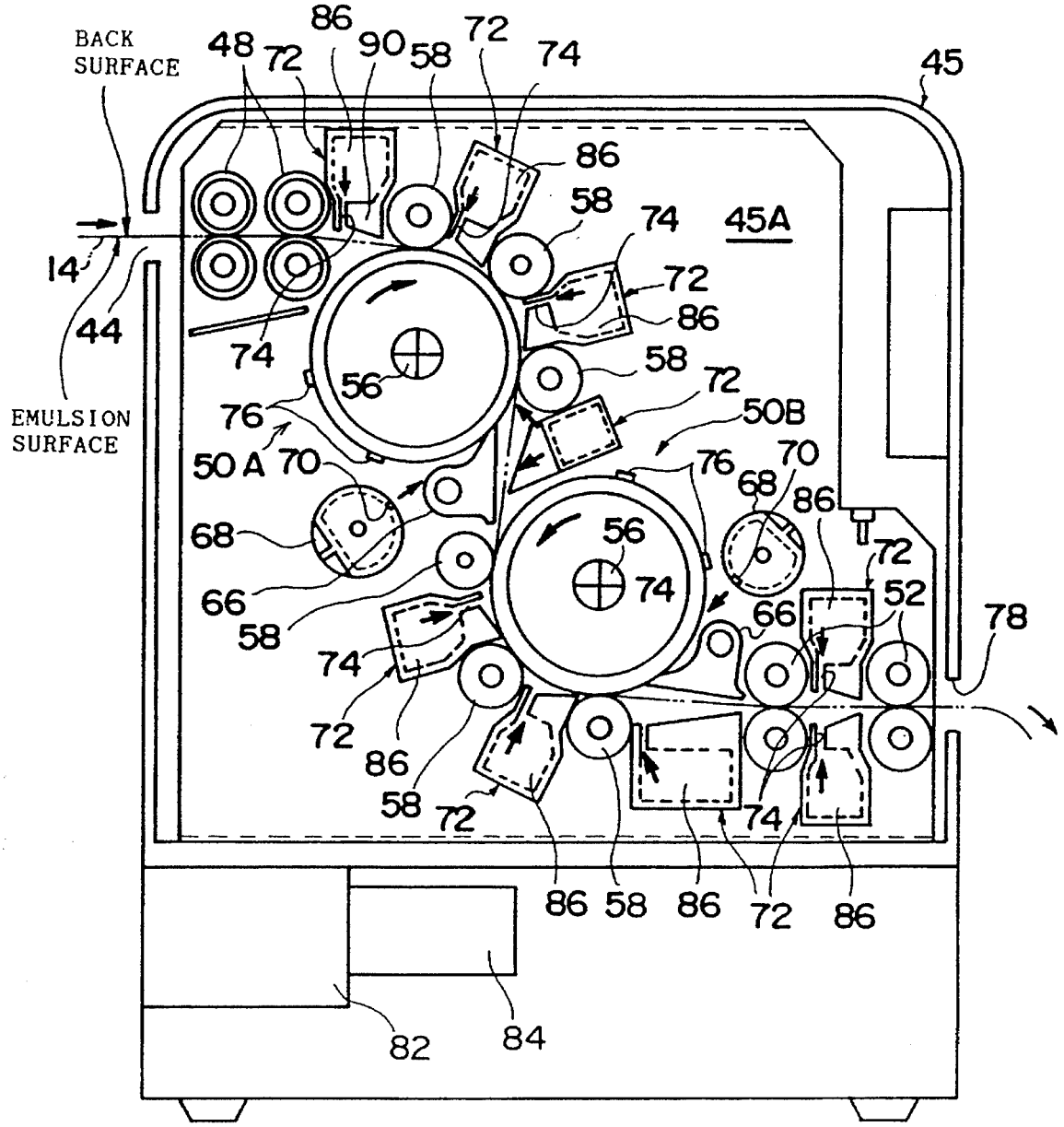
FIG. 6 is a side view illustrating a schematic structure of a drying apparatus.

As illustrated in FIG. 6, the photosensitive material 14 is inserted into the drying chamber 45A of the drying portion 45 from the drying chamber insertion opening 44. The two pairs of squeeze rollers 48, two heat rollers 50A, 50B, and the discharge rollers 52 are provided in the drying chamber 45A along the conveying path of the inserted photosensitive material 14, and are suspended between and axially supported by the pair of side plates 64. Driving force from an unillustrated driving means is transmitted to the squeeze rollers 48, the heat rollers 50A, 50B and the discharge rollers 52 so that the photosensitive material 14 is conveyed at a constant speed.

While the photosensitive material 14 is interposed between and conveyed by the squeeze rollers 48, moisture adhering to the surfaces of the photosensitive material 14 is squeezed therefrom. The photosensitive material 14 is guided by the guide 72 disposed downstream of the squeeze rollers 48 to the outer circumference of one of the heat rollers 50A.

The two heat rollers 50A, 50B are disposed substantially vertically so that the photosensitive material 14 is trained about the respective outer circumferential surfaces thereof.

The heat rollers 50A, 50B are cylindrical. The heating sources 56, which are formed by halogen lamps or the like and which heat the outer peripheral portions (surfaces) of the heat rollers 50A, SOB, are coaxially disposed at axially central portions of the heat rollers 50A, 50B, respectively. The outer circumferences of the heat rollers 50A, 50B are heated by the heat sources 56.

The heat sources 56 are connected to the control portion 100 and are turned on and off by signals from the control portion 100.

A plurality of nip rollers 58 are disposed at peripheries of the respective heat rollers 50A, 50B so that the photosensitive material 14 trained around the heat rollers 50A, 50B is interposed between the outer circumferential surfaces of the heat rollers 50A, 50B and the nip rollers 58. The photosensitive material 14 contacts the respective outer peripheral surfaces of the heat rollers 50A, 50B, which are heated by the heat sources 56, and is heated by heat conduction from the heat rollers 50A, 50B.

A peeling guide 66 is disposed downstream of each of the heat rollers 50A, 50B in the conveying direction of the photosensitive material 14. Ones of ends of the peeling guides 66 slidingly contact the outer circumferential surfaces of the heat rollers 50A, 50B. The other end portions of the peeling guides 66 are axially supported by the side plates 64. The peeling guides 66 peel the photosensitive material 14 trained around the heat rollers 50A, 50B from the outer circumferential surfaces of the heat rollers 50A, 50B at prescribed positions. Further, respective intermediate portions of the peeling guides 66 project toward the downstream side in the conveying direction of the photosensitive material 14 and guide the photosensitive material 14 peeled from the heat rollers 50A, 50B toward the downstream side in the conveying direction.

The guides 72 are also disposed downstream of the respective heat rollers 50A, 50B and between the discharge rollers 52. The photosensitive material 14 being conveyed by the squeeze rollers 48, the heat rollers 50A, 50B and the discharge rollers 52 is guided to the downstream sides of these rollers by the respective guides 72.

In the drying chamber 45A, the temperature sensors 76 are disposed in vicinities of the outer circumferences of the heat rollers 50A, 50B. The surface temperature of the outer circumferential portions of the respective heat rollers 50A, 50B is measured by the temperature sensors 76. Namely, the heating temperature of the photosensitive material 14 is measured. The temperature sensors 76 are connected to the control portion 100. The control portion 100 controls the on/off state of the heat sources 56 based on the temperature detected by the temperature sensors 76. Accordingly, the surface temperature of the heat rollers 50A, 50B can be controlled to a predetermined, set temperature. In the present embodiment, the temperature control effects so-called PID control in which the on time and the off time of the heat sources 56 are determined from the present temperature, details regarding past temperatures, and the like. However, so-called on/off control may be effected in which a set temperature $\theta_S$ is a threshold value. When the temperature exceeds this value, the heat sources 56 are turned off. When the temperature falls below this value, the heat sources 56 are turned on.

Further, when the photosensitive material 14 is not being processed, the heat rollers 50A, 50B are set in a standby state in which the temperature thereof is controlled to a standby temperature which is lower than the set temperature.

The photosensitive material 14 which has undergone drying processing in the drying chamber 45A is discharged from the discharge opening 78 to the exterior of the automatic developer 99.

Figure 7:
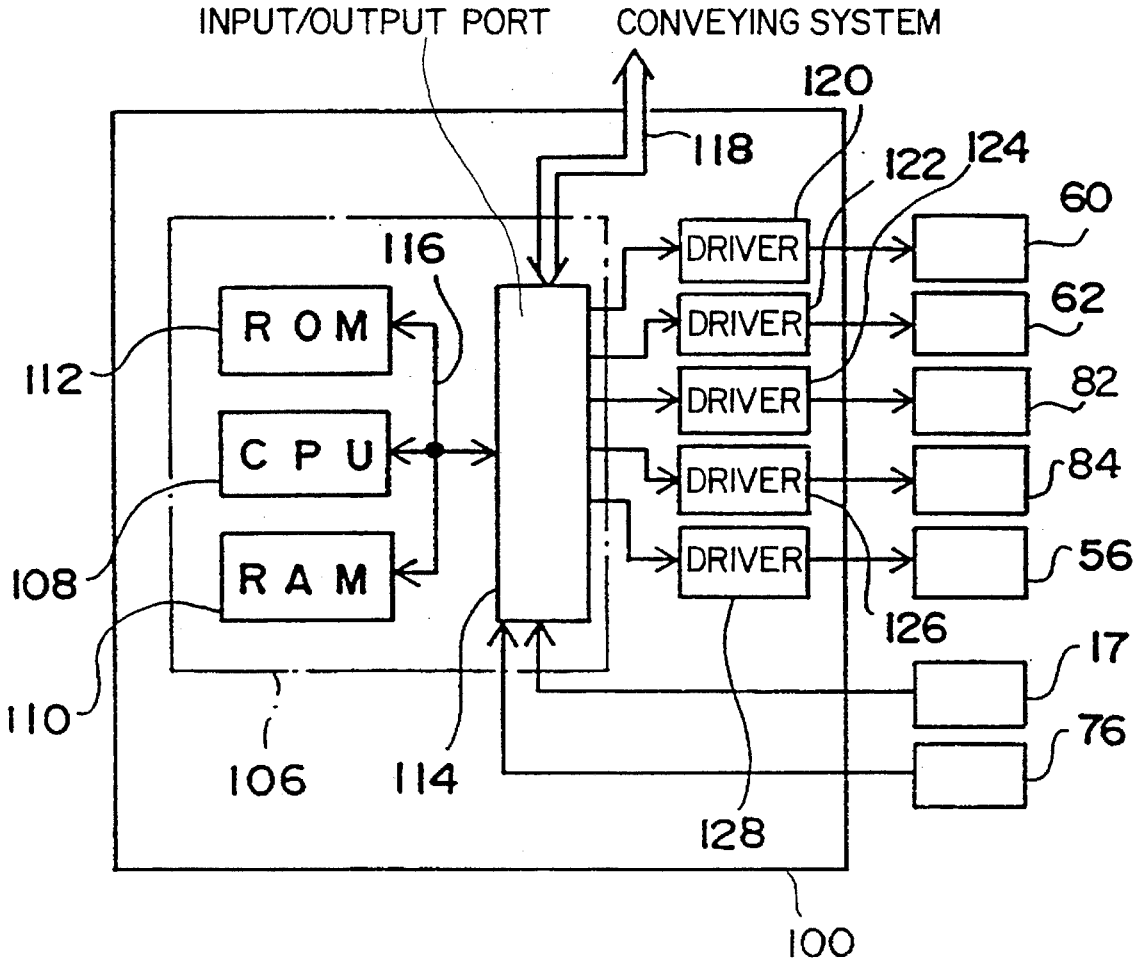
FIG. 7 is a control block view.

As illustrated in FIG. 7, the control portion 100 includes a microcomputer 106. The microcomputer 106 is formed by a CPU 108, a RAM 110, a ROM 112, an input/output port 114, and busses 116, such as data busses and control busses, which connect the aforementioned components.

A signal line 118, which controls the conveying system which conveys the photosensitive material 14 in the processing device, is connected to the input/output port 114. The heaters 60, 62, the fan 82, the heater 84, and the heating sources 56 are connected to the input/output port 114 by drivers 120, 122, 124, 126, 128, respectively. The sensor 17, which detects the existence of the photosensitive material 14, and the temperature sensors 76, which detect the surface temperature of the heat rollers 50A, SOB, are also connected to the input/output port 114.

The set temperature $\theta_S$, which is the surface temperature of the heat rollers 50A, 50B at which processing of the photosensitive material 14 is possible, and a standby temperature $\theta_T$ are stored in the RAM 110.

The control portion 100 of the present embodiment effects control such that the driving of the fan 82 and the heater 84 are turned off when the surface temperature of the heat rollers 50A, 50B rises from the standby temperature 0 T to the set temperature $\theta_S$ and when the surface temperature falls from the set temperature $\theta_S$ to the standby temperature $\theta_T$. It is not necessary that the fan 82 and the heater 84 are both on or both off at the same time. For example, it suffices that only the fan 82 is turned off.

Namely, by continuously driving the fan 82 and the heater 84, the difficulty in raising the surface temperature of the heat rollers 50A, 50B when the temperature is to be raised and the ease of lowering the surface temperature of the heat rollers 50A, 50B when the temperature is to be lowered are prevented.

Next, operation of the present embodiment will be described.

After washing processing in the washing tank 32 has been completed for the photosensitive material 14, the photosensitive material 14 is inserted into the drying chamber 45A of the drying portion 45, is conveyed into the interior of the drying chamber 45A, and is subject to drying processing.

The photosensitive material 14 inserted in the drying chamber 45A is squeezed by the squeeze rollers 48, is guided by the ribs 90 of the guides 72, and is trained around the upstream side heat roller 50A. The photosensitive material 14 is conveyed while trained around the heat roller 50A, and is heated by heat which is transferred from the outer circumferential portion of the heat roller 50A heated by the heating source 56 to the interior of the photosensitive material 14 by heat conduction. Further, a portion of the drying air generated by the fan 82 is blown from the guides 72 to the surface of the photosensitive material 14 which does not contact the heat roller 50A, i.e., the back surface. As a result, moisture evaporates from the back surface of the photosensitive material 14.

Next, the photosensitive material 14 is trained around the downstream side heat roller 50B. At this time, the back surface of the photosensitive material 14 is the surface which contacts the heat roller 50B. As a result, the back surface is heated, and drying air is blown toward the emulsion surface side. While the evaporation of moisture from the emulsion surface side is promoted, the photosensitive material 14 is guided by the guides 72, is interposed between and conveyed by the discharge rollers 52, and is discharged to the exterior of the automatic developer 99 from the discharge opening 78.

As described above, by training the front and rear surfaces of the photosensitive material alternately around the pail of heat rollers 50, the front and rear surfaces can be dried uniformly. Curls and the like which result from lack of uniformity in the drying of the front and rear surfaces can thereby be prevented.

During processing, the heat rollers 50A, 50B are controlled to the set temperature $\theta_S$ as described above (FID control is effected in the present embodiment). When the photosensitive material 14 is not being processed, the surface temperature is controlled to the standby temperature $\theta_T$ so that wasteful heating is prevented and so that, in the drying portion, a rise in temperature greater than that which is necessary is prevented. Further, when the photosensitive material 14 is detected by the sensor 17, the surface temperature of the heat rollers 50A, 50B is raised to the set temperature $\theta_S$.

Figure 8:
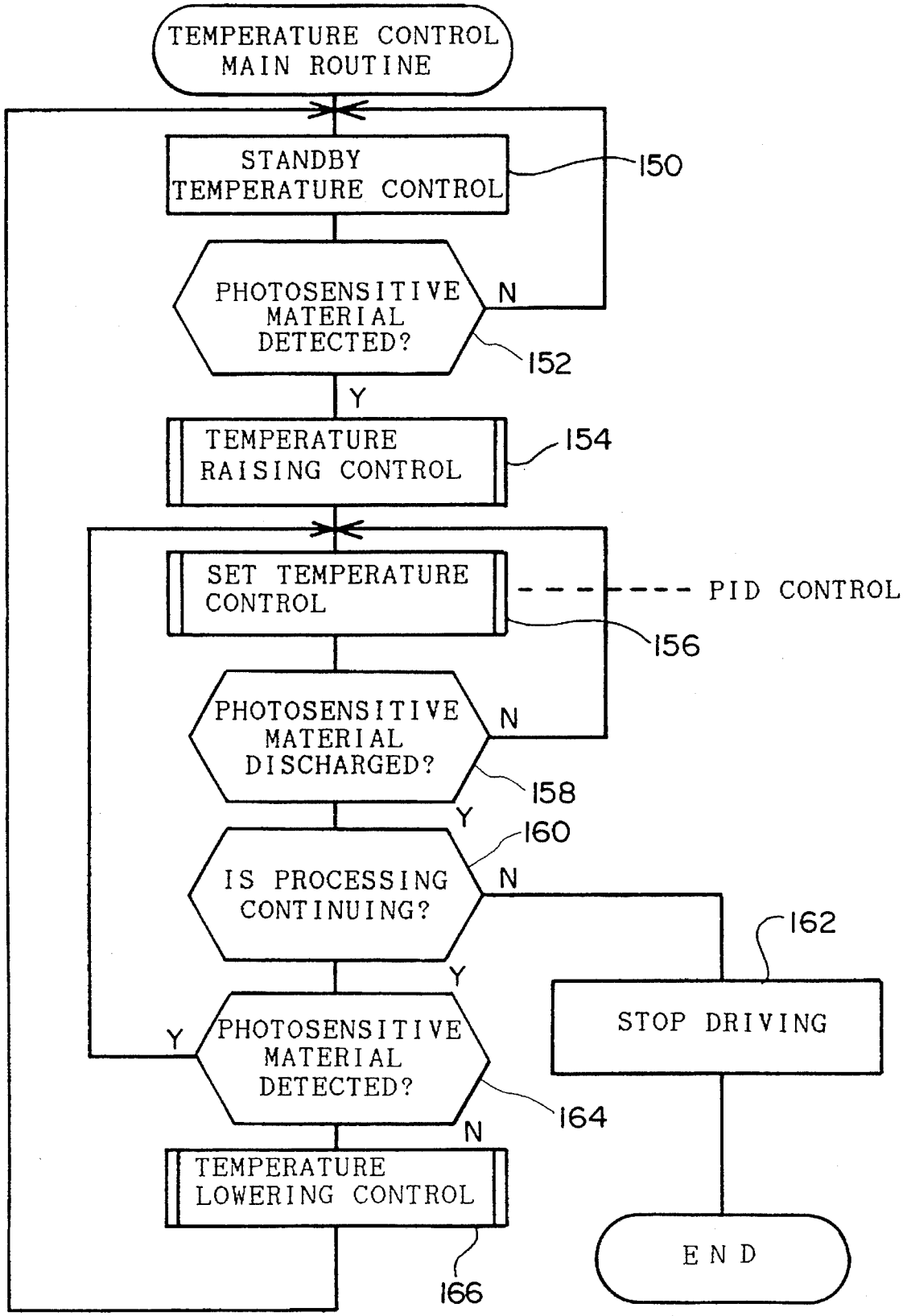
FIG. 8 is a control flowchart illustrating a temperature control main routine.
Figure 9:
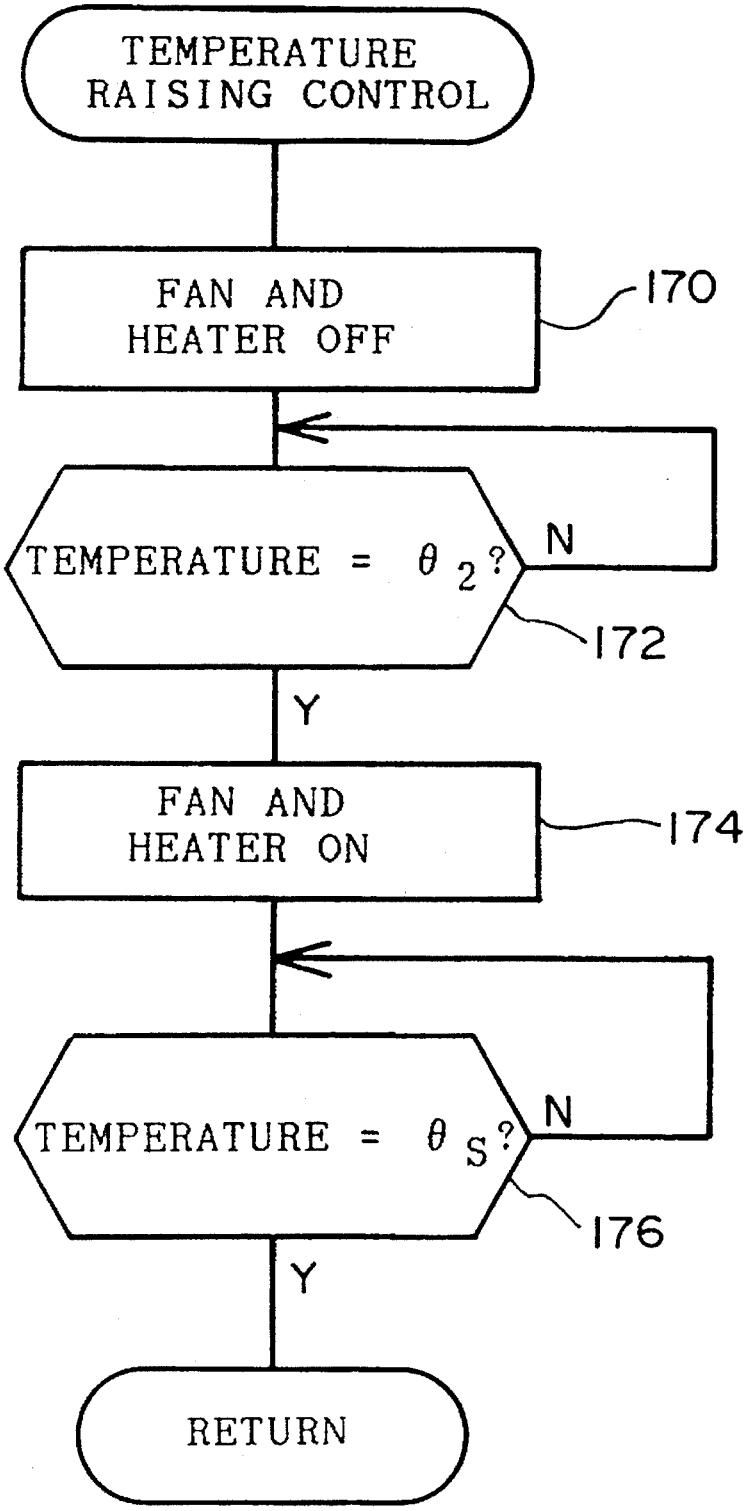
FIG. 9 is a control flowchart illustrating a temperature control routine when the temperature is raised.
Figure 10:
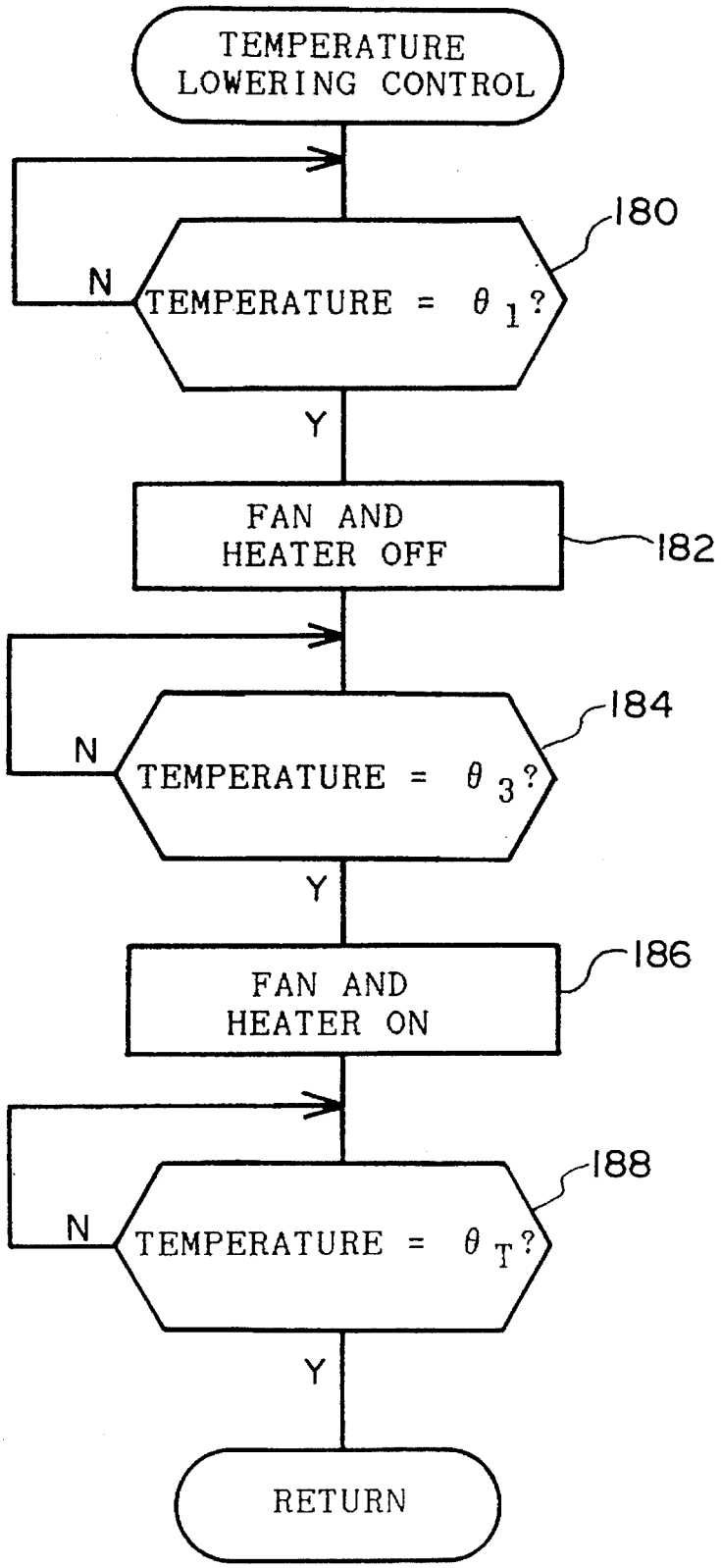
FIG. 10 is a control flowchart illustrating a temperature control routine when the temperature is lowered.

Temperature control of the surface temperature of the heat rollers 50A, 50B will be described hereinafter with reference to the flowcharts in FIGS. 8 through 10.

First, the temperature control main routine will be described in accordance with FIG. 8.

In step 150, standby temperature control is effected. Namely, as preparation for start-up of the apparatus, the heat sources 56, the fan 82 and the heater 84 are driven, and the surface temperature of the heat rollers 50A, 50B is set to the standby temperature $\theta_T$.

In subsequent step 152, a determination is made as to whether the photosensitive material 14 has been detected by the sensor 17. If the answer to-the determination is "Yes", temperature raising; control is effected in step 154. In temperature raising control, the surface temperature of the heat rollers 50A, 50B is raised from the standby temperature $\theta_T$ to the set temperature $\theta_S$. The details of temperature raising control will be described later.

When the surface temperature of the heat rollers 50A, 50B reaches the set temperature $\theta_S$ in step 154, the set temperature $\theta_S$ is maintained in step 156 (PID control).

In step 158, a determination is made as to whether the photosensitive material 14 has been discharged from the drying portion 45. If the answer to the determination is "No", the process returns to step 156, and temperature control is carried out continuously. When the answer to the determination in step 158 is "Yes", the process moves to step 160.

In step 160, a determination is made as to whether processing is continuing. If the answer to the determination is "No", in step 162, the driving of the heat sources 56, the fan 82 and the heater 84 is stopped, and processing is completed. In step 162, by stopping the driving of the heat sources 56 and the heater 84 first and allowing only the fan 82 to be driven for a short while longer, the remaining heat can be reduced rapidly.

If the answer to the determination in step 160 is "Yes", i.e., if processing continues, the process moves to step 164 where a determination is made as to whether the next photosensitive material 14 has been detected by the sensor 17. If the answer to this determination is "Yes", it is necessary to continue the temperature control of the drying portion 45, and the process moves to step 156. If the answer to the determination in step 164 is "No", there is sufficient time until the next photosensitive material 14 reaches the drying portion 45. Therefore, the process moves to step 166 where temperature lowering control is effected to lower the surface temperature of the heat rollers 50A, 50B to the standby temperature $\theta_T$. The process then moves to step 150. The temperature lowering control effected in step 166 will be described later.

Next, the temperature raising control of step 154 of FIG. 8 will be described in accordance with FIG. 9.

When the conveying of the photosensitive material 14 into the processing tank is detected (step 152 of FIG. 8), in step 170, the fan 82 and the heater 84 are turned off so that the supply of drying air is canceled. Accordingly, the rate of change of the rise in temperature from the standby temperature $\theta_T$ to the set temperature $\theta_S$ can be increased (the slope can be increased).

Figure 11:
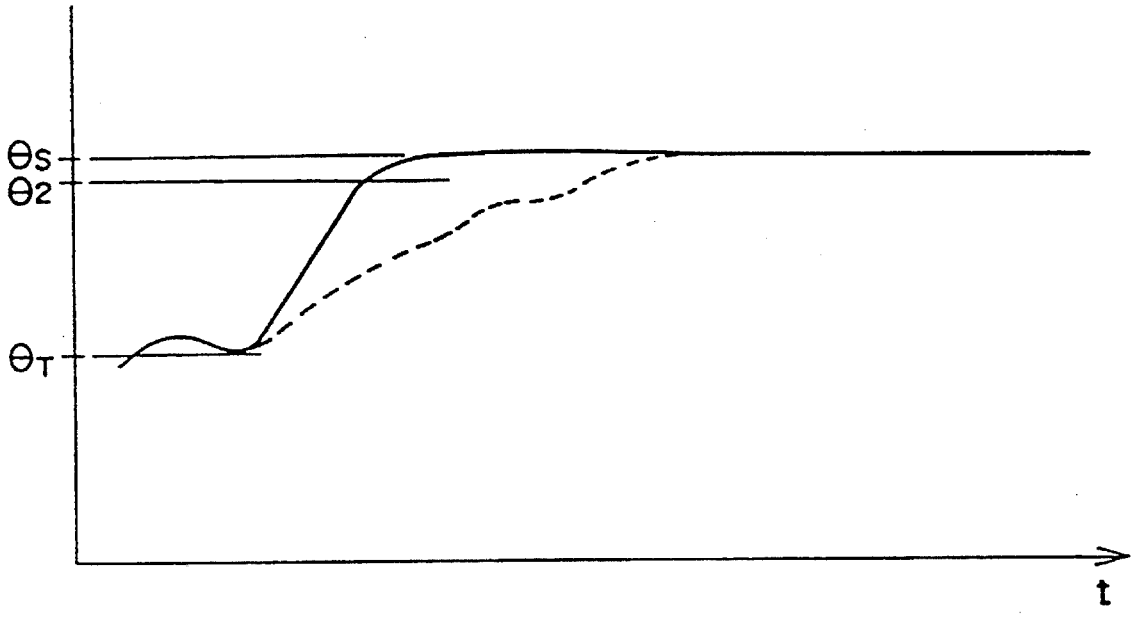
FIG. 11 is a temperature characteristic view when the temperature is raised.

Namely, when the temperature of the drying air is relatively low, continuously driving the fan 82 and the heater 84 works against the rise in surface temperature of the heat rollers 50A, 50B. Therefore, in conventional apparatuses, the rate of change of the rise in temperature (cf. the chain line in FIG. 11) is small (the slope is small). However, in the present embodiment, because the supply of drying air is canceled, the rate of change of the rise in temperature (slope) can be made large, as is illustrated by the solid line in FIG. 11, and the time in which the heat rollers 50A, 50B are heated to the set temperature $\theta_S$ can be decreased by that much.

When the surface temperature of the heat rollers 50A, 50B reaches a temperature $\theta_2$ which is slightly lower than the set temperature $\theta_S$ (step 172), the fan 82 and the heater 84 are driven again (step 174) so that drying air is blown into the drying chamber 45A. Accordingly, the change in temperature becomes more gradual, overshooting of the set temperature $\theta_S$ is prevented, and temperature control from this point on is facilitated.

In step 176, when the surface temperature of the heat rollers 50A, 50B reaches the set temperature $\theta_S$,the process returns to the main routine.

Namely, even if the time from the point when the photosensitive material 14 is conveyed into the processing tank to the point when the photosensitive material 14 reaches the drying portion 45 is shortened and the processing time is shortened, workability can be improved because the surface temperature of the heat rollers 50A, 50B reliably returns to the set temperature $\theta_S$.

Next, temperature lowering control will be described in accordance with FIG. 10.

Figure 12:
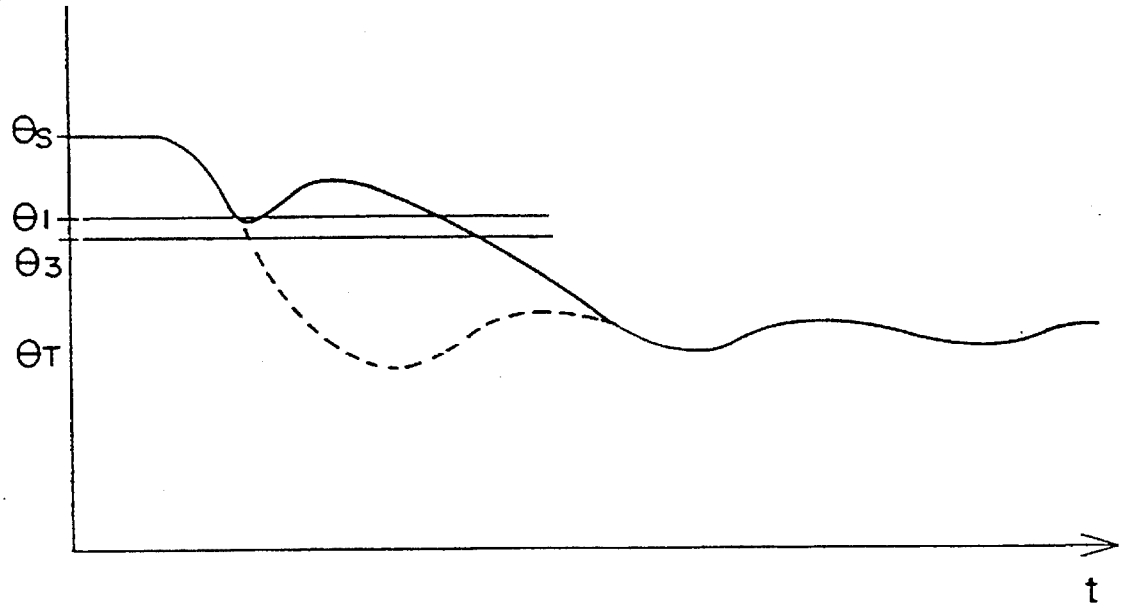
FIG. 12 is a temperature characteristic view when the temperature is lowered.

During temperature lowering, when the fan 82 and the heater 84 are driven continuously, the drying air works to lower the surface temperature of the heat rollers 50A, 50B, as illustrated by the chain line in FIG. 12. Therefore, when the heat sources 56 are turned off, the surface temperature of the heat rollers 50A, 50B decreases sharply (the rate of change in the fall of the temperature is large).

In the present embodiment, when the surface temperature of the heat rollers 50A, 50B reaches a temperature $\theta_1$ which is slightly lower than the set temperature $\theta_S$ (step 180), the driving of the fan 82 and the heater 84 is stopped (step 182) so that, during temperature lowering as well, the supply of drying air is canceled. Due to the cancellation of the supply of drying air, the slope of the fall in temperature becomes small (cf. the solid line in FIG. 12), and the change in temperature becomes gradual. Accordingly, during temperature lowering, when it is detected that the photosensitive material 14 has been conveyed into the processing tank, the surface temperature of the rollers 50A, 50B can be raised again to the set temperature $\theta_S$ in a short time.

In step 184, when a determination is made that the surface temperature of the heat rollers 50A, 50B is a temperature $\theta_3$ approximately midway between the standby temperature $\theta_T$ and the set temperature $\theta_S$, the driving of the fan 82 and the heater 84 is started in step 186. In subsequent step 188, when the surface temperature reaches the standby temperature $\theta_T$, the process returns. Accordingly, in step 150 (FIG. 8), temperature control at the standby temperature $\theta_T$ is continued.

In the present embodiment, during temperature raising: and temperature lowering, the driving of the fan 82 and the heater 84 is stopped so that the supply of drying air is stopped. Therefore, the slope of the change in temperature can be varied appropriately. Further, because the fan 82 and the heater 84 are either on or off, the control system is simple. During temperature raising in particular, by restarting the driving of the fan 82 and the heater 84 at a temperature slightly lower than the set temperature $\theta_S$, overshooting can be prevented.

The above description is an example in which the temperature of the drying air is raised by the heater 84. However, a drying method in which air is blown without being heated is also applicable to the present invention.

A third embodiment of the present invention will be described hereinafter.

Figure 13:
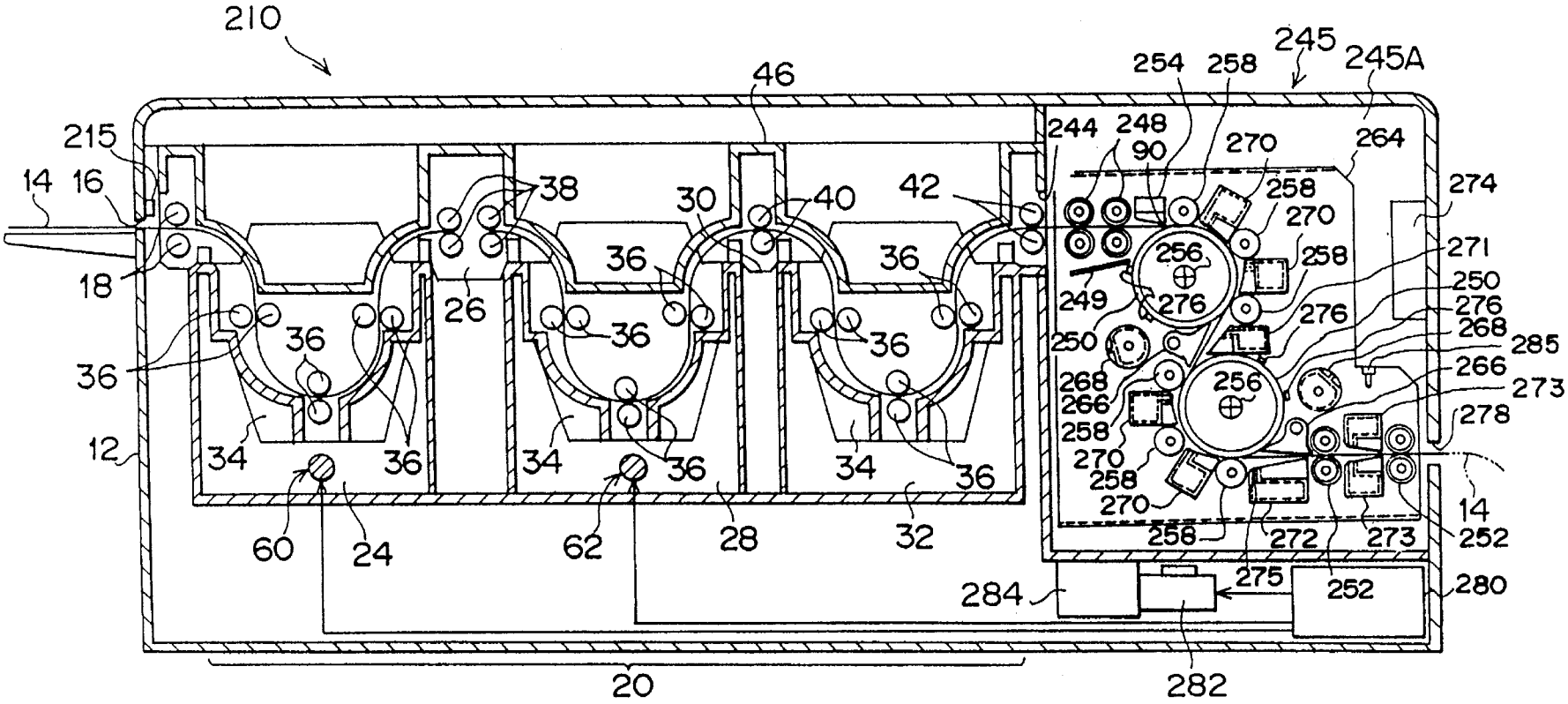
FIG. 13 is a schematic structural view illustrating an automatic developer relating to a third embodiment.

FIG. 13 is a schematic structural view of an automatic developer 210 which is a photosensitive material processing apparatus. The processing portion 20 of the automatic developer 210 of the third embodiment is structured in basically the same way as the processing portion 20 of the automatic developer 10 of the first embodiment. The only difference is that in the automatic developer 210, an insertion detector 215, which detects the insertion of the photosensitive material 14 into the automatic developer 210, is provided at the inner side of the insertion opening 16. In the third embodiment, parts which are the same as those in the first embodiment are denoted by the same reference numerals, and description thereof is omitted.

The photosensitive material 14 which has been processed in the processing portion 20 is conveyed by the pair of conveying rollers 42 to a drying portion 245 adjacent to the processing portion 20. The photosensitive material 14, for which washing processing has been completed in the wash water, is subject to drying processing in the drying portion 245.

As illustrated in FIG. 13, the photosensitive material 14 is inserted into a drying chamber 245A of the drying portion 245 from a drying chamber insertion opening 244. Squeeze rollers 248, two heat rollers 250 and discharge rollers 252 are provided in the drying chamber 245A along the conveying path of the inserted photosensitive material 4, and are suspended between and axially supported by a pair of side plates 264. Driving force from an unillustrated driving means is transmitted to the squeeze rollers 248, the heat rollers 250 and the discharge rollers 252 so that the photosensitive material 14 is conveyed at a constant speed.

While the photosensitive material 14 is interposed between and conveyed by the squeeze rollers 248, moisture adhering to the surfaces of the photosensitive material 14 is squeezed therefrom. The photosensitive material 14 is guided by a guide 254, which is disposed downstream of the squeeze rollers 248 and which is provided with a guide protrusion 290, to the outer circumference of one of the heat rollers 250. An eddy plate 249 is disposed beneath the squeeze rollers 248 (at the lower side of the squeeze rollers 248 in FIG. 13) so that the moisture squeezed from the photosensitive material 14 by the squeeze rollers 248 does not adhere to the heat rollers 250.

The two heat rollers 250 are disposed substantially vertically so that the photosensitive material 14 is trained about the respective outer circumferential surfaces thereof. The heat rollers 250 are cylindrical. An infrared heater 256, which heats the outer peripheral portion of the heat roller 250, is coaxially disposed at an axially central portion of each of the heat rollers 250. Further, a plurality of nip rollers 258 and guides 270 are disposed at the periphery of the outer circumference of the heat roller 250, and guide the photosensitive material 14, which is trained around the heat roller 250, along the outer circumferential surface of the heat roller 250. The photosensitive material 14 contacts the outer circumferential surface of the heat roller 250, which is heated by the infrared radiation heater 256 so that the photosensitive material 14 is heated by heat conduction from the heat roller 250.

A peeling guide 266 is disposed downstream of each of the heat rollers 250 in the conveying direction of the photosensitive material 14. One end of the peeling guide 266 contacts the outer circumferential surface of the heat roller 250, and the other end portion thereof is axially supported by the side plates 264. The peeling guide 266 peels the photosensitive material 14 trained around the heat roller 250 from the outer circumferential surface of the heat roller 250 at a prescribed position. Further, an intermediate portion of the peeling guide 266 projects toward the downstream side in the conveying direction of the photosensitive material 14 and guides the photosensitive material 14 peeled from the heat roller 250 toward the downstream side in the conveying direction.

Guides 271, 272, 273 are disposed downstream of the respective heat rollers 250 and between the discharge rollers 252. The photosensitive material 14 being conveyed by the heat rollers 250 and the discharge rollers 252 is guided to the respective downstream sides of these rollers by the guides 271, 272, 273.

The guides 270 through 273 are each an elongated, pipe-shaped body having one closed end. The longitudinal directions of the guides 270 through 273 run along the transverse direction of the photosensitive material 14. The guides 270 through 273 are fixed to the side plates 264 (this construction is unillustrated). A plurality of guide projections are formed along the transverse direction of the photosensitive material 14 on the surfaces of the guides 270 through 273 at the side of the conveying path of the photosensitive material 14. The guide protrusions stand upright along the conveying direction. The downstream sides, in the conveying direction of the photosensitive material 14, of the guide projections project more than the upstream sides thereof. The guide projections are inclined in a direction of approaching the conveying path of the photosensitive material 14. Further, slits 275 are formed in the guides 270 through 273 so as to be inclined toward a vicinity of the guide projections in the longitudinal direction. The hollow, interior portions of the guides 270 through 273 and vicinities of the conveying path of the photosensitive material 14 are thereby communicated. Drying air from a drying air supplying means is supplied to the guides 270 through 273 which discharge the drying air towards the photosensitive material 14. Moreover, the sectional area of the opening of the hollow, interior portion of the guides 270 through 273 gradually decreases so that the drying air supplied to one longitudinal direction end thereof is discharged substantially uniformly along the transverse direction of the photosensitive material 14.

In the drying chamber 245A, blow-out pipes 268 are disposed at the outer circumferential surfaces of the heat rollers 250 so as to be directed towards vicinities of the peeling guides 266. The interior portion of the blow-out pipe 268 is hollow. Unillustrated slits, which communicate with the interior portion of the blow-out pipe 268, are formed along the transverse direction of the photosensitive material 14 in the surface of the blow-out pipe 268 at the side of the photosensitive material 14. In the same way as guides 270 through 273, drying air is supplied to the blow-out pipes 268 from the drying air supplying means.

The drying air supplied to the blow-out pipes 268 and to the guides 270 through 273 is discharged toward the surfaces of the photosensitive material 14 from the respective slits. The air which contains much moisture and which is located in the vicinities of the surfaces of photosensitive material 14 heated by the heat rollers 250 is removed and dried by the drying air. The photosensitive material 14, which has undergone drying processing in the drying chamber 245A, is discharged to the exterior of the automatic developer 210 from a discharge opening 278. Further, when an exhaust fan 274 is operated, the air within the drying chamber 245A is discharged to the exterior of the automatic developer 210.

A fan 282 and a heater 284 which generate drying air are disposed beneath the drying chamber 245A. The generated drying air is supplied to the blow-out pipes 268 and to the guides 270 through 273 via unillustrated ducts. Although the heater 284 is provided in the present embodiment, air outside of the automatic developer 210 may be supplied to the drying chamber 245A by the fan 282 without providing the heater 284. Alternatively, most of the air within the drying chamber 245A may be recirculated by the fan 282 and some of the air used may be taken in from outside the automatic developer 210 and supplied to the interior of the drying chamber 245A.

In the drying chamber 245A, drying temperature sensors 276 are disposed in vicinities of the peripheries of the outer circumferences of the heat rollers 250. The surface temperature of the outer circumferential portions of the respective heat rollers 250 is measured by the drying temperature sensors 276. Namely, the heating temperature of the photosensitive material 14 is measured. The temperature within the drying chamber 245A is measured by a drying chamber temperature sensor 285.

Figure 14:
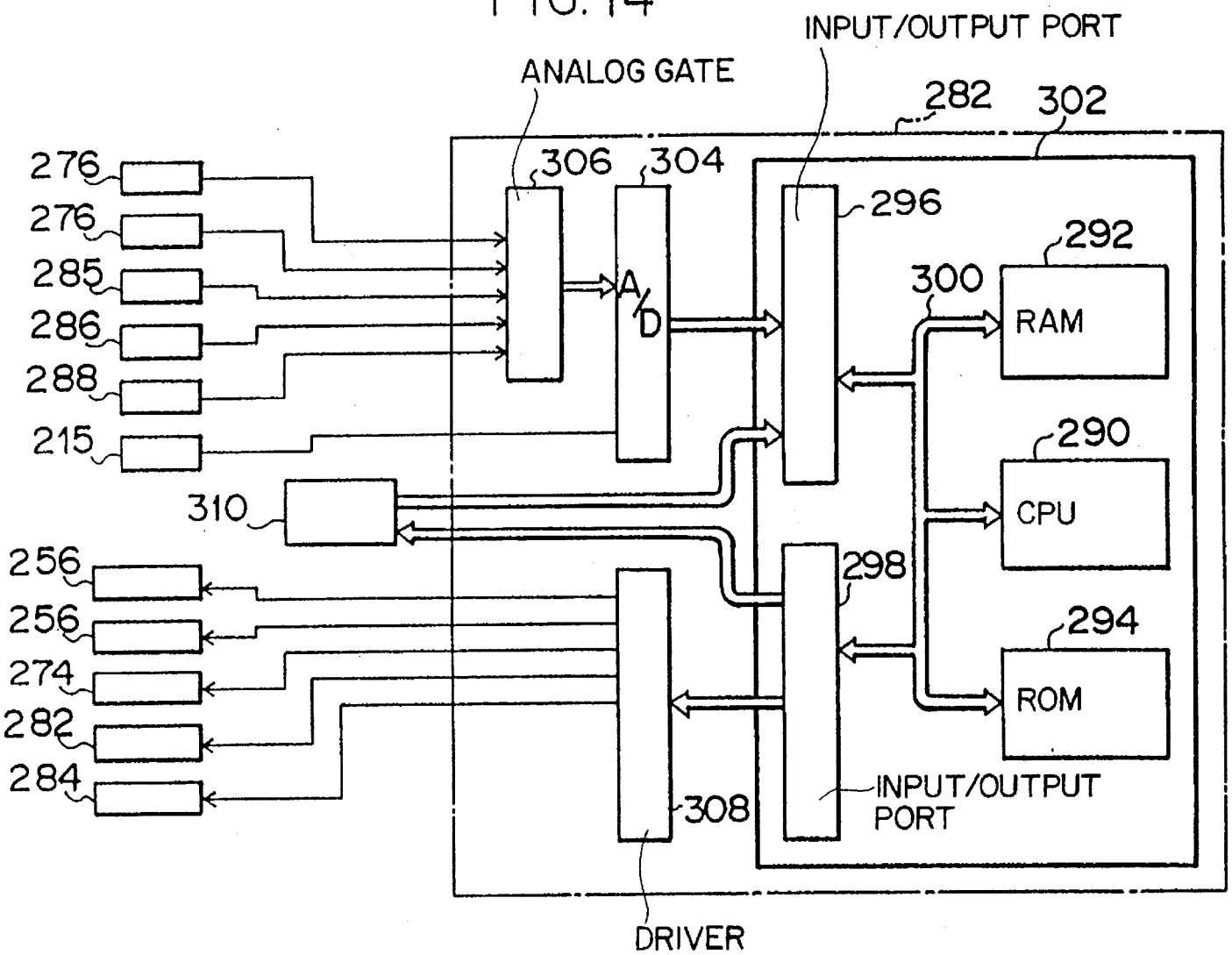
FIG. 14 is a block view illustrating a control portion applied to the present invention.

As illustrated in FIG. 14, the infrared heaters 256, the drying temperature sensors 276, the exhaust fan 274, the fan 282, the heater 284 and the drying chamber temperature sensor 285 are connected to a control portion 280. The drying conditions of the photosensitive material 14 in the drying portion 245 are controlled by the control portion 280. Further, an outside air humidity sensor 286, which detects the humidity and the temperature or the humidity outside the developing apparatus 210, and a temperature sensor 288, which detects the temperature outside of the apparatus, are connected to the control portion 280. The temperature and humidity of the operating environment of the automatic developer 210 are thereby detected.

The control portion 280 includes a microcomputer 302, an A/D converter 304, an analog gate 306 and a driver 308. The microcomputer 302 is formed by a CPU 290, a RAM 292, a ROM 294, an input port 296, and an output port 298 which are all connected by busses 300.

The drying temperature sensors 276, the drying chamber temperature sensor 285, the outside air humidity sensor 286, and the outside air temperature sensor 288 are connected to the input side of the analog gate 306, and are connected to the input port 296 of the microcomputer 302 via the A/D converter 304. In addition, the insertion detector 215 is connected to the input port 296 via the A/D converter 304.

The infrared heaters 256 of the heat rollers 250, the exhaust fan 274, the fan 282 and the heater 284 are connected to the output side of the driver 308, and are driven by a control signal from the output port 298. An operation panel 310 of the automatic developer 210 is connected to the input port 296 and to the output port 298 of the microcomputer 302. By operating keys on the operation panel 310, the input of data to the control portion 280 and the display of output from the control portion 280 are possible. The control portion 280 also controls other processing portions of the automatic developer 210. The conveying means which conveys the photosensitive material 14, the heaters 60, 62 (omitted from FIG. 14), and the like are also connected to the control portion 280.

Figure 15:
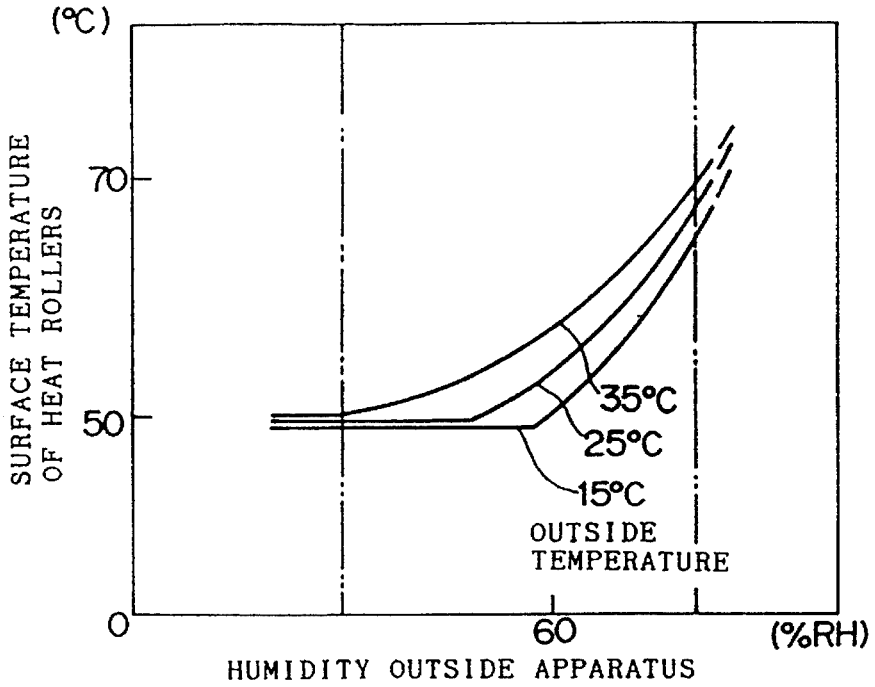
FIG. 15 is a graph illustrating a relationship between humidity of an operating environment and a surface temperature of heat rollers.
Figure 16:
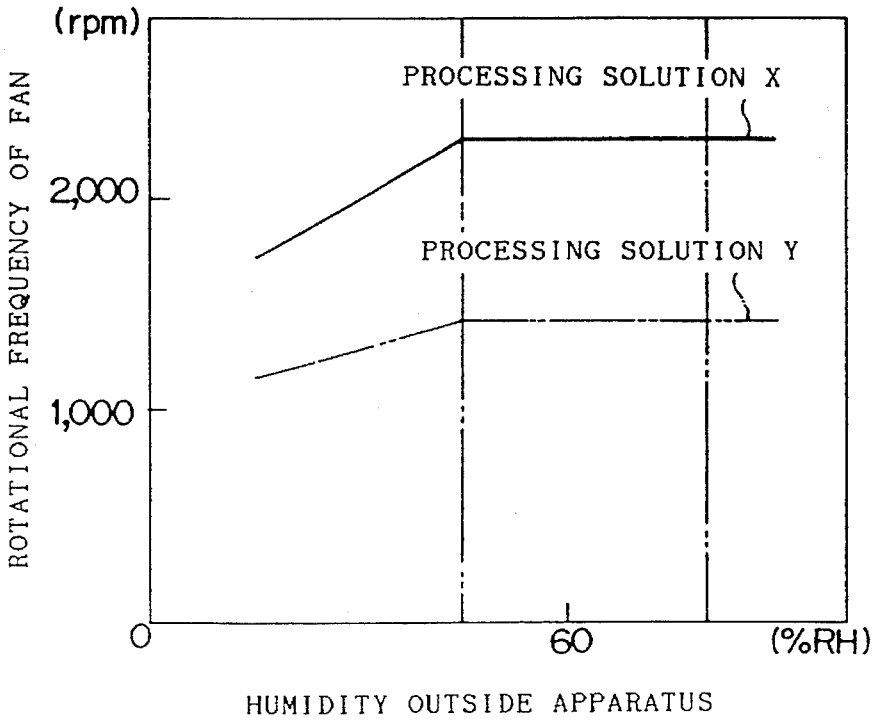
FIG. 16 is a graph illustrating a relationship between the humidity of the operating environment and a rotational frequency of a fan.

In the drying portion 245, the heating temperature at which the photosensitive material 14 is heated by the heat rollers 250 and the amount of drying air generated by the fan 282 are determined by the humidity and the temperature outside of the apparatus (the humidity and the temperature of the outside air). Further, the amount of drying air is determined in accordance with the processing solutions. These characteristics are illustrated in FIGS. 15 and 16. FIG. 15 is a characteristic view showing optimal drying temperatures. The maximum temperatures of the surfaces of the heat rollers 250 at which the photosensitive material 14 will not be overdried is shown per outside temperature, in accordance with the humidity of the outside air. FIG. 16 is a characteristic view showing the rotational frequency (rpm) of the fan 282, and illustrates the rotational frequency of the fan 282 per processing solution, in accordance with the humidity of the outside air. As an example, a case is illustrated in which the temperature of the outside air is 25° C. Further, in the present embodiment, with the maximum rotational frequency of the fan 282 being 2700 rpm, the standard amount of drying air is 2.0 $m^2$/min at approximately 2300 rpm when a processing solution X which does not harden the membrane surface of the photosensitive material 14 is used. When a processing solution Y which hardens the membrane surface of the photosensitive material 14 is used, the standard amount of drying air is 1.2 $m^2$/min at approximately 1400 rpm.

Figure 17:
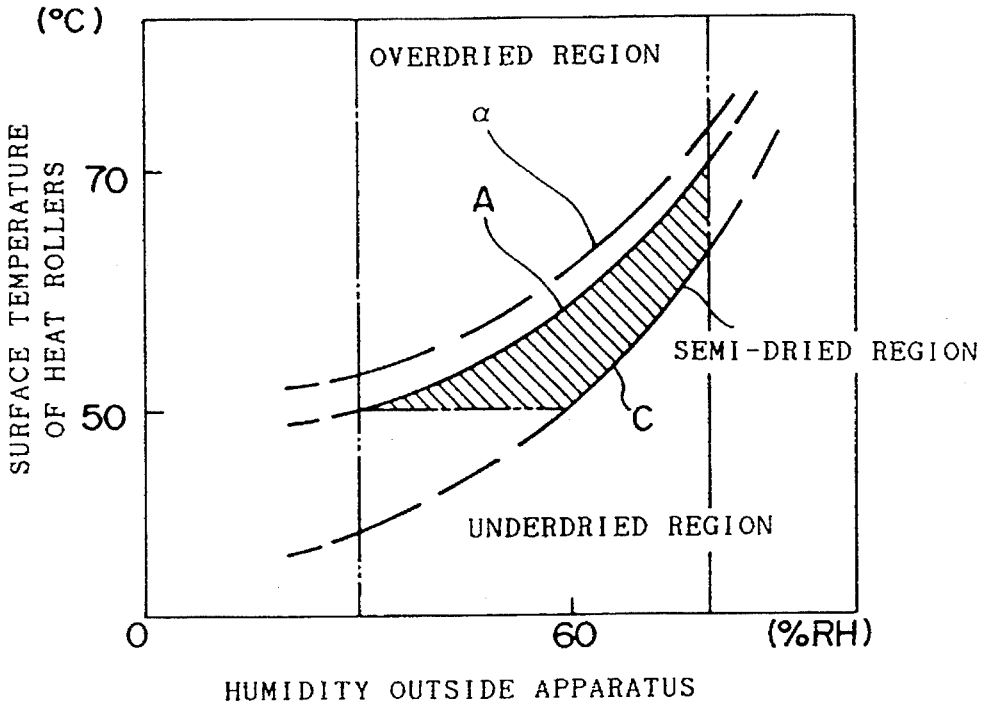
FIG. 17 is a graph illustrating drying conditions of a photosensitive material based on the relationship between the humidity of the operating environment and the surface temperature of the heat rollers.
Figure 18:
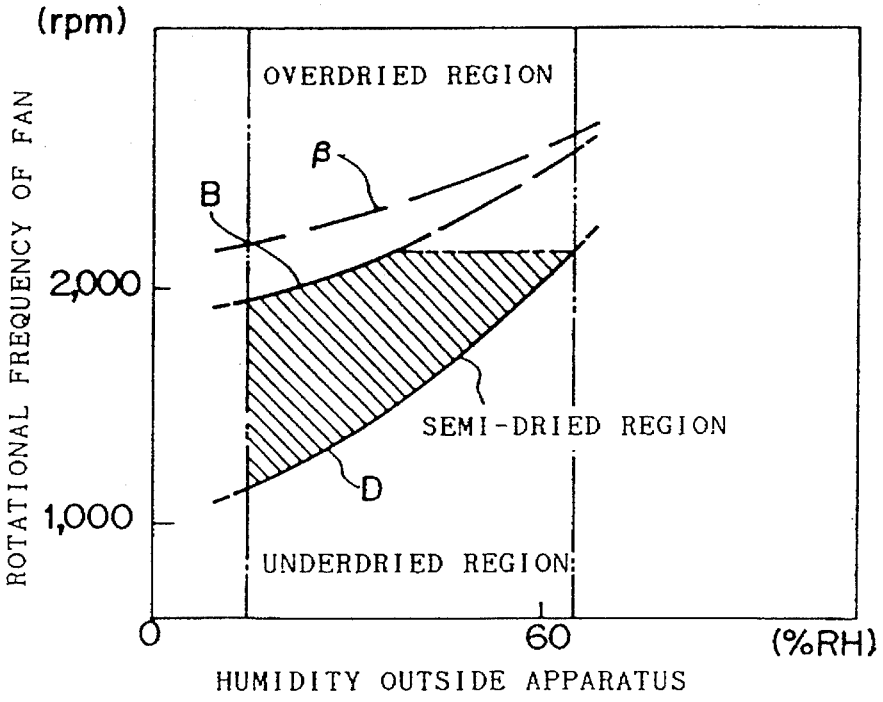
FIG. 18 is a graph illustrating drying conditions of the photosensitive material based on the relationship between the humidity of the operating environment and the rotational frequency of the fan.

The maps shown in FIGS. 17 and 18 are stored in the RAM 292 of the microcomputer 302 based on these characteristics and standards. The map of FIG. 17 illustrates the relationship between the surface temperature of the heat rollers 250 (drying temperature) and the humidity of the outside air. The map of FIG. 18 illustrates the relationship between the rotational frequency of the fan 282 and the humidity of the outside air. These maps are provided per outside air temperature. Maps for an outside air temperature of 25° C. are illustrated here as an example.

Curve A in FIG. 17 is an optimal heal curve for the heat rollers 250 when the processing solution X is used. Curve B in FIG. 18 is a curve showing the optimal rotational frequency of the fan 282 when the surface temperature of the heat rollers 250 is 50° to 55° C. using the processing solution X. By controlling the surface temperature of the heat rollers 250 and the rotational frequency of the fan 282 based on the curves A, B, the amount of moisture contained by the photosensitive material 14 immediately after drying is made to be the same as the amount of moisture contained by the photosensitive material 14 during exposure. Namely, the amount of moisture contained by the photosensitive material 14 before processing is known because the humidity of the outside air is known. Therefore, if the amount of moisture less the above amount is dried, the amount of moisture contained in the dried photosensitive material 14 can be equilibrated with the humidity of the outside air. Further, the curves A, B are characteristics determined in advance by results of experiments and the like. Optimal drying conditions of the photosensitive material 14 can be obtained by these curves A, B.

Curve C in FIG. 17 and curve D in FIG. 18 are respectively the minimum heat curve and the minimum rotational frequency curve at which underdrying of the photosensitive material 14 will not occur. At areas beneath these curves, the photosensitive material 14 discharged from the drying portion 245 is underdried and will adhere to other discharged photosensitive materials 14. Accordingly, in the present embodiment, the infrared heaters 256 are controlled so that the surface temperature of the heat rollers 250 falls in a semi-dried region above the minimum heat curve (curve C) and below the optimal heat curve (curve A) shown in FIG. 17. Moreover, the rotational frequency of the fan 282 is controlled to fall in a semi-dried region above the minimum rotational frequency curve (curve D) and below the optimal rotational frequency curve (curve B) illustrated in FIG. 18.

In the semi-dried regions at positions near the curve C in FIG. 17 and the curve D in FIG. 18, the amount of moisture after drying is slightly higher than that during exposure. However, by leaving the photosensitive material 14 in the operating environment, the amount of moisture contained in the photosensitive material 14 and the humidity of the outside air can be equilibrated. As a result, in the present embodiment, the amount of moisture is controlled to reach the semi-dried region when the photosensitive material 14 is between the position at which it is peeled from the downstream heat roller 250 and the discharge opening 278. The surface temperature of the heat rollers 250 is set to be less than or equal to 70° C. in order to reduce the exhaust heat and to prevent thermal deformation of the photosensitive material 14 and the like. Further, a curve $\alpha$ in FIG. 17 illustrates an upper limit on the overdried side of the optimal heat curve, and a curve $\beta$ in FIG. 18 illustrates an upper limit on the overdried side of the optimal rotational frequency curve. These curves show the permissible ranges on the overdried side. Even if the photosensitive material 14 is overdried slightly, the dimensional error is negligible in actuality (the rate of change in dimension from before processing to after processing is less than or equal to 0.005%).

Manufacturing data of the photosensitive material and the processing solutions is input to the control portion 280 by key operation of the operation panel 310. Manufacturing data of the photosensitive material includes membrane thickness, whether the photosensitive material is hard in the drying portion 245, and the like. Manufacturing data of the processing solutions includes mainly the effects of the developing solution and the fixing solution, which are the main processing solutions, on the drying time, and in particular, whether the fixing solution has a hardening effect. Namely, it can be determined from the input from the operation panel 310 to what degree the photosensitive material 14 processed in the processing portion 20 will swell and whether the membrane surface of the photosensitive material 14 will harden. Further, in the automatic developer 210, ordinary processing, which does not take dimensional stability in particular into consideration, can also be carried out by key input.

Next, operation of the present embodiment will be described.

When an unillustrated power source switch of the automatic developer 210 is turned on, the temperatures of the developing solution in the developing tank 24 and the fixing solution in the fixing tank 28 are raised to predetermined temperatures by the heaters 60, 62. After the temperatures have risen, predetermined temperature ranges are maintained. Further, manufacturing data of the photosensitive material 14 and the fixing solution is input from the operation panel 310 to the automatic developer 210.

Thereafter, the photosensitive material 14 is inserted from the insertion opening 16 into the automatic developer 210, and is processed.

When the photosensitive material 14 is inserted into the interior of the automatic developer 210 from the insertion opening 16, the photosensitive material 14 is pulled in by the conveying rollers 18, is guided by the guide surface of the crossover rack 46, and is conveyed into the developing tank 24. In the developing tank 24, the photosensitive material 14 is interposed between the rollers 36 provided in the rack 34. While being conveyed through the developing solution in a substantially U-configuration, the photosensitive material 14 undergoes developing processing by the developing solution, and is then discharged to the downstream side.

The photosensitive material 14 discharged from the developing tank 24 is washed with wash water in the rinsing tank 26 while being conveyed by the rollers 38 of the rinsing tank 26. Thereafter, the photosensitive material 14 is guided by the guide surface of the crossover rack 46 so as to be conveyed to the fixing tank 28. In the fixing tank 28, the photosensitive material 14 is interposed between the rollers 36 provided in the rack 34. While being conveyed through the fixing solution in a substantially U-configuration, the photosensitive material 14 undergoes fixing processing by the fixing solution, and is then discharged to the downstream side.

The photosensitive material 14 discharged from the fixing tank 28 is washed with wash water while being conveyed by the rollers 40 in the rinsing tank 30. The photosensitive material 14 reaches the washing tank 32 and is conveyed by the rack 34 through the wash water so as to undergo washing processing. The developing solution and the fixing solution stored in the developing tank 24 and the fixing tank 28, respectively, are [leafed by the heaters 60, 62 to predetermined temperatures at which processing of the photosensitive material 14 is possible, and are maintained at these temperatures.

After washing processing in the washing tank 32 has been completed for the photosensitive material 14, the photosensitive material 14 is inserted into the drying chamber 245A of the drying portion 245, is conveyed to the interior of the drying chamber 245A, and is subject to drying processing.

The photosensitive material 14 inserted in the drying chamber 245A is squeezed by the squeeze rollers 248, is guided by the guide projection 290 of the guide 254, and is trained around the upstream side heat roller 250. The photosensitive material 14 is conveyed while trained around the heat roller 250, and is heated by heat which is transferred from the outer circumferential portion of the heat roller 250 heated by the infrared heater 256 to the interior of the photosensitive material 14 by heat conduction. Further, a portion of the drying air generated by the fan 282 and the heater 284 is blown from the blow-out pipes 268 toward the surfaces of the photosensitive material 14. A portion of the drying air is supplied to the guides 270 through 273, and is blown from the slits 275 of the guides 270 through 273 toward the surface of the photosensitive material 14.

After the photosensitive material 14 has been subjected to drying processing by the heat rollers 250 and the drying air blown from the blow-out pipes 268 and the guides 270 through 273, the photosensitive material 14 is discharged from the discharge opening 278 to the exterior of the automatic developer 210.

Operation of the drying portion 245 of the automatic developer 210 will now be described in accordance with the flowcharts in FIGS. 19 and 20.

Figure 19:
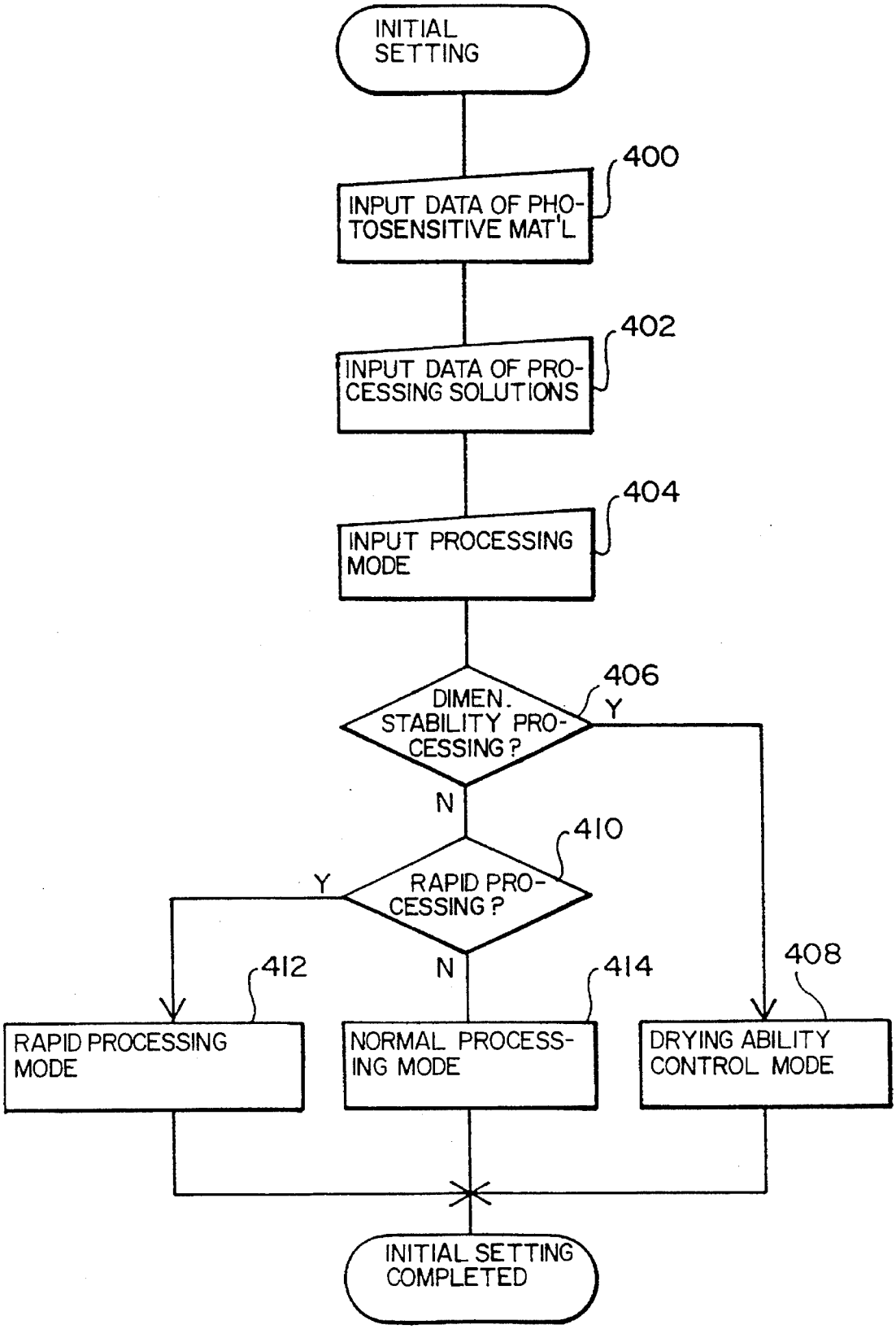
FIG. 19 is a flowchart illustrating an initial setting of a control portion relating to the third embodiment.

FIG. 19 illustrates a flowchart for initial setting of the control portion 280. The initial setting precedes and breaks into each of three processing modes: "drying ability control mode", "rapid processing mode" and "normal processing mode".

Before the photosensitive material 14 is processed, in step 400, the manufacturing data of the photosensitive material 14 is input to the control portion 280, and in step 402, the manufacturing data of the developing solution, the fixing solution and the like is input to the control portion 280. When the photosensitive material 14 is to be processed, in step 404, regular processing or dimensional stability processing is selected and input.

In step 406, a determination is made in the control portion 280 as to whether "dimensional stability processing" has been input. If dimensional stability processing is to be effected, in step 408, the "drying ability control mode" is set. Further, when "normal processing" is input from the operation panel 310, a determination is made in step 410, from the manufacturing data of the photosensitive material 14 and that of the fixing solution, as to whether "rapid processing" is possible. If rapid processing is to be effected, the "rapid processing mode" is set in step 412. If rapid processing is not to be carried out, the "normal processing mode" is set in step 414.

In dimensional stability processing, there exist a plurality of combinations of the photosensitive materials 14, developing solutions and fixing solutions. A first combination is a combination of a photosensitive material and processing solutions corresponding to rapid processing, in which a determination is made that the membrane surface of the photosensitive material 14 processed in the processing portion 20 does not harden, or in which a determination is made that hardening is suppressed. Because much moisture is included in this type of photosensitive material 14, drying irregularities occur easily when the photosensitive material 14 is heated and dried quickly. In this case, after an outside temperature t and an outside humidity h have been measured by the outside air humidity sensor 286 and the outside air temperature sensor 288, the control portion 280 sets a surface temperature $T_1$ of the heat rollers 250 and a rotational frequency $F_1$ from FIGS. 15 and 16 (a determination is made based on the processing solution X curve).

In the drying portion 245, while the photosensitive material 14 is heated to the surface temperature $T_1$ by the heat rollers 250, drying air, which is generated by the fan 282 rotating at rotational frequency $F_1$, is blown on the surfaces of the photosensitive material 14. Accordingly, the photosensitive material 14 is dried in a short time. When the photosensitive material 14 is discharged from the discharge opening 278 of the automatic developer 210, the amount of moisture contained in the photosensitive material 14 corresponds to the humidity h of the operating environment.

A second combination is a combination of a photosensitive material and processing solutions which correspond to normal processing. The normal processing mode is selected when it is determined that the membrane of the photosensitive material 14 processed in the processing portion 20 hardens. In this case, the temperature t and the humidity h outside of the apparatus are measured by the outside air humidity sensor 286 and the outside air temperature sensor 288. Based on these values, a surface temperature $T_2$ of the heat rollers 250 and a rotational frequency $F_2$ of the fan 282 are set in the control portion 280 from FIGS. 15 and 16 (a determination is made from the processing solution Y curve).

With a combination of a photosensitive material and processing solutions which correspond to rapid processing, when processing is to be effected in a shorter time than the standard processing time and dimensional stability of the photosensitive material 14 is not particularly required, the "rapid processing mode" is selected.

The "normal processing mode" is selected when there is a combination of a photosensitive material and processing solutions which correspond to normal processing. In this processing mode, with the exception of photosensitive materials having a portion with a thick membrane surface, when the processing time (the time from the point when the photosensitive material 14 is inserted from the insertion opening 16 to the point when the photosensitive material 14 is discharged from the discharge opening 278) is greater than or equal to 50 seconds, in order to achieve the prescribed drying conditions, the fan 282 may be stopped ($F_2$=0 rpm), and air within the drying chamber 245A may be discharged by the exhaust fan 274 such that outside air is sucked in by natural intake. Accordingly, when the photosensitive material 14 is discharged from the discharge opening 278, the photosensitive material 14 is in a semi-dried state. By leaving the photosensitive material 14 in outside air, the amount of moisture contained in the photosensitive material 14 is equilibrated with the humidity h of the outside air.

Figure 20A:
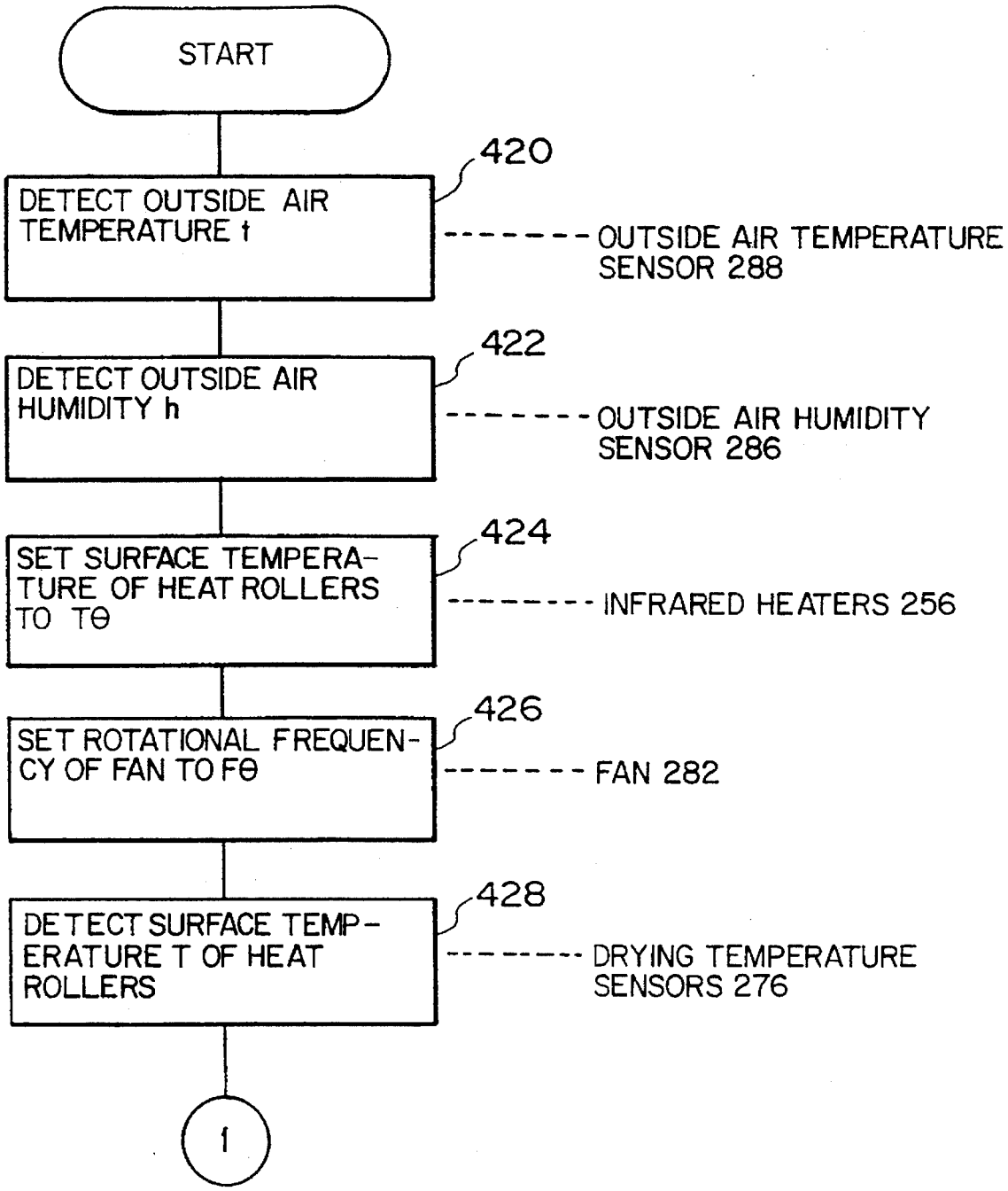
FIGS. 20A and 20B are flowcharts illustrating an example of operation of a drying portion relating to the third embodiment.
Figure 20B:
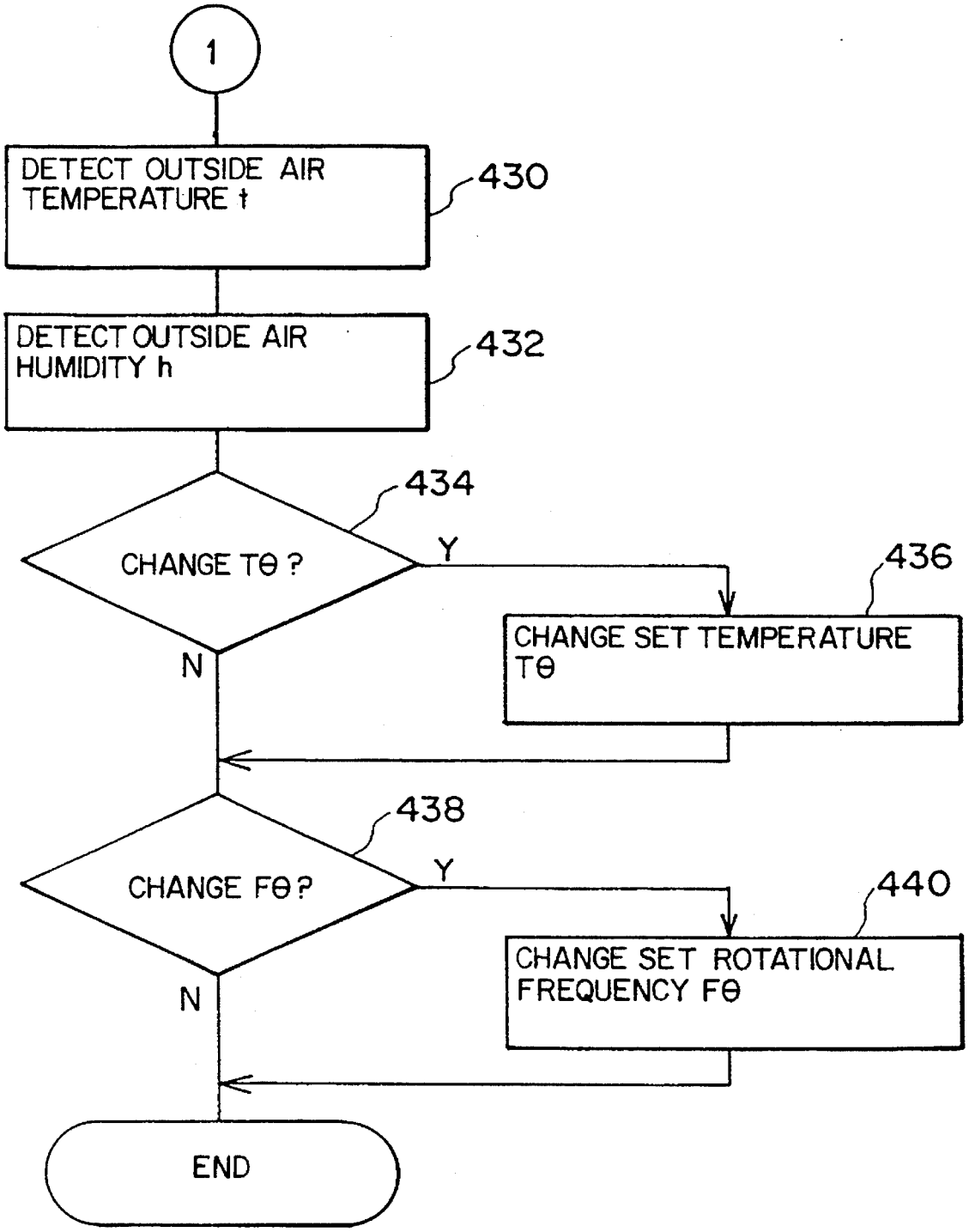

FIGS. 20A and 20B illustrate drying ability control mode flowcharts. In the drying ability control mode, in step 420, which is usually started at a predetermined interval (e.g., every two seconds), the temperature t of the outside air (the temperature of the operating environment) is measured by the outside air temperature sensor 288. In step 422, the humidity h of the outside air (the humidity of the operating environment) is measured by the outside air humidity sensor 286. In steps 424, 426, the set temperature Tθ of the heat rollers 250 and the set rotational frequency Fθ of the fan 282 are respectively determined based on the outside air temperature t, the outside air humidity h, and the maps shown in FIGS. 17 and 18 which were stored in advance. Further, the infrared heaters 256 and the fan 282 are controlled in accordance with these set values. The outer circumferential portions of the heat rollers 250 are heated to the set temperature by the infrared heaters 256. Further, drying air is blown uniformly from the blow-out pipes 268 and the guides 270 through 273.

When drying processing of the photosensitive material 14 begins in the drying portion 245, the surface temperature T of the heat rollers 250 is measured by the drying temperature sensors 276 (step 428). The outside air temperature t and the outside air humidity h are measured by the outside air temperature sensor 288 and the outside air humidity sensor 286 (steps 430, 432).

In step 434, the drying temperature T ( the surface temperature of the heat rollers 250) and the set temperature Tθ are compared, and a determination is made, from the results of measurement of the outside air temperature t and the outside air humidity h and from the map shown in FIG. 17 which was stored in advance, as to whether it is necessary to change the set temperature Tθ. When the drying temperature T falls outside of the semi-dried region of the map shown in FIG. 17 (the hatched portion in FIG. 17), the infrared heaters 256 are control led to change the set temperature Tθ (step 436).

In step 438, a determination is made, from the drying temperature T, the outside air temperature t and the outside air humidity h, as to whether the set rotational frequency Fθ of the fan 282 falls outside of the semi-dried region shown in FIG. 18 (the hatched portion in FIG. 18). When the set rotational frequency Fθ fails outside of this region, in step 440, the fan 282 is control led to change the set rotational frequency Fθ.

Accordingly, in the drying ability control mode of the control portion 280, the outside air temperature t, the outside air humidity h, and the drying temperature (the surface temperature of the heat rollers 250) T are measured as a predetermined sample cycle. The heating of the heat rollers 250 by the infrared heaters 256 and the rotational frequency of the fan 282 are control led so as to fall within the semi-dried regions of the maps shown in FIGS. 17 and 18. In this way, immediately after or several seconds after the photosensitive material 14 dried in the drying portion 245 is peeled from the downstream .heat roller 250, constant-rate drying ends, and falling-rate drying begins so that the photosensitive material 14 is in a semi-dried state when discharged from the discharge opening 278. Immediately after the photosensitive material 14 is discharged or after the photosensitive material 14 has been left in the outside air for a predetermined time, the amount of moisture contained in the photosensitive material 14 corresponds to the humidity of the outside air.

In the drying portion 245 of the automatic developer 210 of the present embodiment, the surface temperature T of the two heat rollers 250 is detected by the drying temperature sensors 276 and is controlled by the control portion 280 so that the photosensitive material 14 is in a drying state set in advance. The drying of the photosensitive material 14 is furthered by heat conduction from the respective drying rollers 250. The heat conduction, together with the drying air blown to the photosensitive material 14, lowers the amount of moisture contained in the photosensitive material to a predetermined amount. This predetermined amount of moisture is, as described previously, substantially equal to the amount of moisture contained in the photosensitive material 14 during exposure. In this way, the dimensions of the supporting body, the emulsion layer and the backing layer of the finished photosensitive material 14 are equal to their respective dimensions during exposure.

In the control portion 280, the heating temperature at which the heat rollers 250 heat the photosensitive material 14 and the amount of drying air generated by the fan 282 are controlled in accordance with the manufacturing data of the processing solutions (the fixing solution in particular) and in accordance with the measured outside air humidity and temperature or the outside air humidity. As a result, the dimensional stability of the photosensitive material 14 processed by the automatic developer 210 is not adversely effected even in a processing time close to that of the rapid processing mode. Even when photosensitive materials 14 are continuously processed, irregularities are not generated in the finish of the photosensitive materials 14.

Because the heat generated in the drying chamber 245A can be kept to the minimum amount necessary, the drying portion 245 can be operated efficiently, and the heat exhausted from the interior of the drying chamber 245A can be kept to a minimum. Deterioration of the operating environment in the vicinity of the automatic developer 210 can thereby be repressed.

In the automatic developer 210 relating to the present embodiment, in the "normal processing mode" used for normal drying processing and in the "rapid processing mode" as well, the surface temperature of the heat rollers 250 and the rotational frequency of the fan 282 are controlled. Therefore, heat loss in the drying portion 245 can be repressed, and the amount of heat discharged from the drying chamber 245A can be kept down.

In the present embodiment, among manufacturing data of the photosensitive material 14 and manufacturing data of the processing solutions, emphasis is placed on whether the membrane surface of the photosensitive material 14 processed in the processing portion 20 hardens. However, control can be effected with consideration given to more specific items such as membrane thickness of the photosensitive material 14, other components within the fixing solution, the effects of the developing solution and the washing solution on the drying of the photosensitive material 14, and the like. Further, the temperature within the drying chamber 245A may also be controlled. By minutely setting the drying conditions, a high-quality finish of the photosensitive material 14 can be achieved.

What is claimed is:

1. A photosensitive material drying method for drying a photosensitive material conveyed along a conveying path, comprising the steps of:

bringing both surfaces of said photosensitive material alternately into contact with outer circumferential surfaces of a plurality of heat rollers heated by heat sources each of said heat rollers being heated from the interior thereof by one of said heat sources;

heating said photosensitive material using an amount of heat determined on a basis of a temperature of the outer surfaces of said heat rollers and on the basis of contact time of said photosensitive material and said heat rollers; and evaporating moisture from a surface of said photosensitive material not contacting said heat rollers.

2. A photosensitive material drying method according to claim 1, wherein drying air is blown to the surface of said photosensitive material not contacting said heat rollers so as to promote evaporation of the moisture.

3. A photosensitive material drying method according to claim 1, wherein the contact time of each of said heat rollers and said photosensitive material is 1.5 to 5 seconds.

4. A photosensitive material drying method according to claim 1, wherein the temperature of the outer surfaces of said heat rollers is less than or equal to 80° C.

5. A photosensitive material drying apparatus for drying a photosensitive material conveyed along a conveying path, comprising:

a first heat roller equipped with a heat source in an interior portion of said first heat roller, said photosensitive material being rolled around said first heat roller such that one surface of said photosensitive material contacts a portion of a circumferential surface of said first heat roller;

a second heat roller equipped with a heat source in an interior portion of said second heat roller, said photosensitive material being rolled around said second heat roller such that another surface of said photosensitive material contacts a portion of a circumferential surface of said second heat roller;

a chamber having an opening in the vicinity of said conveying path, said opening being provided along a transverse direction of said photosensitive material for receiving into the chamber said photosensitive material which is conveyed while rolled around said first heat roller and said second heat roller;

drying air supplying means for supplying drying air into said chamber; and wherein said photosensitive material is maintained in contact with said first and second heat rollers over an angle greater than 80° of said circumferential surfaces.

6. A method of controlling a surface temperature of a heat roller in a photosensitive material drying apparatus in which a photosensitive material which has been processed by processing solutions is conveyed in sticking on the heat roller whose surface temperature is controlled to a predetermined temperature, and in which drying air is blown to an outer surface of the heat roller so as to promote evaporation of moisture on the surface of the photosensitive material stuck on the outer surface of said heat roller, comprising a step of:

stopping blowing of said drying air during a period in which the surface temperature of said heat rollers is raised from a standby temperature lower than said predetermined temperature to said predetermined temperature so as to increase the rate of change of the surface temperature of said heat rollers.

7. A method of controlling temperature according to claim 6, wherein blow of said drying air is effected by driving a fan which blows out said drying air from a drying device or a heater which heats said drying air, said stopping blowing of said drying air being effected by either stopping driving of said fan or stopping driving of said fan and said heater.

8. An apparatus for controlling surface temperature of a heat roller which conveys and dries a photosensitive material trained around an outer surface of said heat roller, comprising:

drying air supplying means equipped with blow-out openings provided along a conveying path and supplying drying air to said photosensitive material; and drying air supply controlling means for stopping supply of said drying air by said drying air supplying means during a period in which the surface temperature of said heat roller is raised from a standby temperature lower than a predetermined temperature to said predetermined temperature.

9. An apparatus for controlling surface temperature of said heat roller according to claim 8, wherein said drying air supplying means comprises a fan which blows out said drying air, the supply of said drying air being stopped by stopping driving of said fan.

10. An apparatus for controlling surface temperature of said heat roller according to claim 8, wherein said drying air supply controlling means begins the supply of said drying air when the surface temperature of said heat rollers is a temperature slightly lower than said predetermined temperature during raising of the surface temperature of said heat rollers.

11. A method of controlling surface temperature of a heat roller in a photosensitive material drying apparatus in which a photosensitive material is conveyed while contacting the heat roller, and in which drying air is blown to a surface of said photosensitive material not contacting said heat rollers so as to promote evaporation of moisture, comprising a step of:

stopping blowing of said drying air during a period in which the surface temperature of said heat rollers is lowered from a predetermined temperature to a standby temperature lower than said predetermined temperature so as to decrease the rate of change of temperature of the surface temperature of said heat rollers.

12. An apparatus for controlling surface temperature of a heat roller in a photosensitive material drying apparatus in which a photosensitive material is conveyed while contacting said heat rollers and in which drying air is blown to a surface of said photosensitive material not contacting said heat rollers so as to promote evaporation of moisture, comprising:

drying air supplying means equipped with blow-out openings provided along a conveying path and supplying drying air to said photosensitive material; and drying air supply controlling means for stopping supply of said drying air by said drying air supplying means during a period in which the surface temperature of said heat rollers is lowered from a predetermined temperature to a standby temperature lower than said predetermined temperature.

13. An apparatus for controlling surface temperature of a heat roller according to claim 12, wherein said drying air supplying means comprises a fan which blows out said drying air and a heater which heats said drying air, the supply of said drying air being stopped by stopping driving of said fan or stopping driving of said fan and said heater.

14. An apparatus for controlling temperature according to claim 12, wherein said drying air supply controlling means begins the supply of said drying air when the surface temperature of said heat rollers is a temperature slightly higher than said standby temperature during lowering of the surface temperature of said heat rollers.

15. A method for controlling a photosensitive material drying apparatus equipped with main drying means for heating a photosensitive material, a subordinate drying means for blowing drying air to photosensitive material, and a measuring means for measuring a humidity and/or a temperature of an operating environment, comprising a step of:

controlling a heating temperature of said main drying means and an amount of drying air blown out from said subordinate drying means in accordance with a type of photosensitive material, types of processing solutions which process photosensitive material, the humidity and/or the temperature measured by said measuring means.

16. A method for controlling the photosensitive material drying apparatus according to claim 15, wherein the heating temperature of said main drying means and the amount of drying air blown from said subordinate drying means are controlled so that an amount of moisture contained in said photosensitive material dried by said photosensitive material drying apparatus is equilibrated with a humidity of the operating environment.

17. A method for controlling the drying apparatus according to claim 16, wherein the heating temperature of said main drying means and the amount of drying air blown from said subordinate drying means are controlled so that a degree of drying photosensitive material is in a semi-dried condition when photosensitive material is dried by said main drying means and drying of photosensitive material by said photosensitive material drying apparatus is completed.

18. A method for controlling the drying apparatus according to claim 15, wherein the type of said photosensitive material depends on whether photosensitive material contains hardening agent.

19. A method for controlling the drying apparatus according to claim 15, wherein the types of processing solutions depend on whether a fixing bath contains hardening agent.

20. A photosensitive material drying apparatus, comprising:

input means for inputting type of photosensitive material and data regarding processing solutions which process said photosensitive material;

environment measuring means for measuring a temperature and a humidity or a humidity of the environment;

drying means for heating said photosensitive material and blowing drying air to said photosensitive material so as to dry said photosensitive material; and a control portion for controlling a heating temperature at which said drying means heats said photosensitive material and an amount of drying air of said heating means in accordance with data from said input means and said environment measuring means.

21. A photosensitive material drying apparatus according to claim 20, wherein said drying means is equipped with a heat roller around which said photosensitive material is trained and conveyed and whose outer circumferential surface heats said photosensitive material contacting the outer circumferential surface.

22. A photosensitive material drying apparatus according to claim 21, wherein a constant rate drying said photosensitive material is carried out by heating by said heat rollers.

* * * * *